US009366038B1

(12) United States Patent
Huelskoetter et al.

(10) Patent No.: US 9,366,038 B1
(45) Date of Patent: Jun. 14, 2016

(54) ABSORBENT FLOOR SYSTEM ND METHOD OF INSTALLATION

(71) Applicants: Jeffrey Patrick Huelskoetter, St. Louis, MO (US); Richard Lee Marchbanks, St. Louis, MO (US)

(72) Inventors: Jeffrey Patrick Huelskoetter, St. Louis, MO (US); Richard Lee Marchbanks, St. Louis, MO (US)

(73) Assignee: CLOSED LOOP RECYCLING, LLC, St. Louis, MO (US)

( * ) Notice: Subject to any disclaimer, the term of this patent is extended or adjusted under 35 U.S.C. 154(b) by 0 days.

(21) Appl. No.: 14/336,035

(22) Filed: Jul. 21, 2014

Related U.S. Application Data

(60) Provisional application No. 61/856,539, filed on Jul. 19, 2013.

(51) Int. Cl.
*E04F 15/02* (2006.01)
*E04F 13/08* (2006.01)
*A47G 27/02* (2006.01)

(52) U.S. Cl.
CPC ..... *E04F 15/02133* (2013.01); *A47G 27/0293* (2013.01); *E04F 13/0882* (2013.01)

(58) Field of Classification Search
CPC ..... E04F 15/02; E04F 15/02138; E04F 15/02155; E04F 13/0882; A47G 27/0293; A47G 27/0206; A47G 27/045
USPC ..... 52/506.05, 711; 15/215, 216; 428/99, 428/100, 101
See application file for complete search history.

(56) References Cited

U.S. PATENT DOCUMENTS

| | | | | | |
|---|---|---|---|---|---|
| 3,817,015 | A * | 6/1974 | Frangos | 52/511 | |
| 3,909,996 | A * | 10/1975 | Ettlinger et al. | 52/177 | |
| 4,609,580 | A * | 9/1986 | Rockett et al. | 428/198 | |
| 4,631,765 | A * | 12/1986 | Casey | 5/417 | |
| 4,822,658 | A * | 4/1989 | Pacione | A47G 27/0437 | 428/100 |
| 4,822,669 | A * | 4/1989 | Roga | 442/373 | |
| 4,968,548 | A * | 11/1990 | Gibson et al. | 428/95 | |
| 5,114,774 | A * | 5/1992 | Maxim, Jr. | 428/101 | |
| 5,506,040 | A * | 4/1996 | Cordani | 428/218 | |
| 5,658,430 | A * | 8/1997 | Drake et al. | 156/71 | |
| 5,834,104 | A * | 11/1998 | Cordani | 428/218 | |
| 5,962,350 | A * | 10/1999 | Krotine | 442/370 | |
| 5,970,541 | A * | 10/1999 | Chiang | 5/420 | |
| 6,083,596 | A * | 7/2000 | Pacione | 428/62 | |
| 6,294,240 | B1 * | 9/2001 | Brunetto | 428/99 | |

(Continued)

*Primary Examiner* — James Ference
(74) *Attorney, Agent, or Firm* — Bryan Cave LLP

(57) ABSTRACT

A system of reusable absorbent mats that are secured or interlocked to one another and secured to the floor of an industrial, commercial, garage, workshop, or manufacturing facility thereby reducing the possibility that the absorbent mats could bunch up or slip. The absorbent mats of the absorbent floor system are secured to the floor and to one another to provide a stable and secure walking surface. The absorbent mats can be layered to accommodate high oil leaking areas. The absorbent floor mat system can wick oil, grease, coolant and/or other fluids throughout the entire floor to provide a safe walking zone for industrial and manufacturing facilities. Individual absorbent mats can be swapped out as they become fully saturated prior to a full reinstallation. When the absorbent mats are removed from the floor of the facility, they can be cleaned and recycled.

1 Claim, 15 Drawing Sheets

(56) References Cited

U.S. PATENT DOCUMENTS 6,298,624 B1 * 10/2001 Pacione ..... A47G 27/025 52/311.2
6,306,477 B1 * 10/2001 Pacione ..... A47G 27/0293 428/100
6,395,362 B1 * 5/2002 Pacione ..... A47G 27/0293 428/100
6,458,442 B1 * 10/2002 McKay ..... 428/40.1
6,460,303 B1 * 10/2002 Pacione ..... A47G 27/025 428/100
6,475,594 B2 11/2002 Johnston et al.
6,481,063 B2 * 11/2002 Shepard ..... A44B 18/0049 24/30.5 R
6,586,066 B1 * 7/2003 Buckwalter et al. ..... 428/40.1
6,652,947 B2 * 11/2003 Sweeney et al. ..... 428/43
6,663,937 B2 * 12/2003 Ullman et al. ..... 428/100
6,875,494 B2 * 4/2005 Lianos et al. ..... 428/138
6,911,407 B2 * 6/2005 Sherrod et al. ..... 442/76
8,518,516 B1 * 8/2013 Konasiewicz et al. ..... 428/100
2002/0088074 A1 * 7/2002 Johnston et al. ..... 15/215
2003/0017300 A1 * 1/2003 Clay ..... 428/100
2003/0024062 A1 * 2/2003 McKay ..... 15/215
2003/0070391 A1 * 4/2003 Tachauer ..... A44B 18/0049 52/745.21
2003/0135947 A1 * 7/2003 McKay ..... 15/215
2004/0019994 A1 * 2/2004 Kessler et al. ..... 15/215
2004/0261208 A1 * 12/2004 McKay ..... 15/215
2005/0284704 A1 * 12/2005 Hernandez ..... 184/106
2009/0038251 A1 * 2/2009 Pacione ..... A47G 27/0293 52/506.05
2009/0062432 A1 * 3/2009 Doesburg et al. ..... 524/16
2009/0178364 A1 * 7/2009 Uhlig ..... 52/718.04
2010/0055430 A1 * 3/2010 Wilkerson ..... B32B 5/18 428/215
2011/0195219 A1 * 8/2011 Bell et al. ..... 428/88
2011/0318548 A1 * 12/2011 Fedeli et al. ..... 428/196
2012/0011795 A1 * 1/2012 Pacione ..... A47G 27/0293 52/506.05
2012/0164369 A1 * 6/2012 Tardif ..... 428/99
2013/0115437 A1 * 5/2013 Johnston et al. ..... 428/220

* cited by examiner

ABSORBENT FLOOR SYSTEM AND METHOD OF INSTALLATION

FIELD OF THE INVENTION

This invention relates generally to oil absorbent mats for use in industrial, commercial, garage, workshop or manufacturing facilities and, more particularly, to a system of interlocked absorbent mats for placement on a floor.

BACKGROUND OF THE INVENTION

Oil, grease, coolant and/or other fluids may accumulate on the floor around machinery, work tables, racks, and the like in industrial, commercial, garage, workshop, or manufacturing facilities. Absorbent mats may be used to absorb oil, grease, coolant and/or other fluids but are typically simply placed on the floor and are free to move around. Accordingly, such mats can bunch up or develop ridges creating a trip hazard. Such mats can also slip as persons walk over them, thereby defeating or minimizing any benefit that they provide by absorbing oil, grease, coolant or other fluids.

SUMMARY OF THE INVENTION

The present invention utilizes a system of absorbent mats that are secured or interlocked to one another and secured to the floor of an industrial, commercial, garage, workshop, or manufacturing facility (all of which are referred to herein as a "manufacturing facility"). The system as contemplated by the present invention covers large areas of a facility at which the system is installed, including heavily traveled walkways. Accordingly, one embodiment of the absorbent floor system is a complex system of interlocking absorbent mats. The absorbent mats are secured to the floor and to one another to provide a stable and secure walking surface. The absorbent mats may be layered to accommodate high oil leaking areas and/or to reduce and/or eliminate the flow of oil, grease, coolant and/or other fluids into undesired areas. The absorbent floor system may wick oil, grease, coolant and/or other fluids throughout the entire floor to provide a safe walking zone for manufacturing facilities. The absorbent floor system may also prevent such oil, grease, coolant and/or other fluids from propagating to areas of the facility floor that are not covered by the absorbent floor system such as visitor walkways, forklift driveways, truck driveways, stairs, etc. Individual absorbent mats may be swapped out as they become fully saturated prior to a full reinstallation. When the absorbent mats are removed from the floor of the facility, they may be cleaned or recycled.

Briefly, therefore, one embodiment of the present invention is directed to an absorbent floor system for absorbing oil, grease, coolant and/or other fluids comprising a population of single sided hook fasteners adhered to a floor of a manufacturing facility, and a population of absorbent mats wherein at least one of the population of absorbent mats is secured directly to the population of single side hook fasteners.

Another embodiment of the present invention is directed to an absorbent floor system for absorbing oil, grease, coolant and/or other fluids comprising a population of single sided hook fasteners adhered to a floor of a manufacturing facility; a population of absorbent mats wherein at least one of the population of absorbent mats is secured directly to the population of single side hook fasteners; and a liner placed on the floor under at least one of the population of absorbent mats.

Another embodiment of the present invention is directed to an absorbent floor system for absorbing oil, grease, coolant and/or other fluids wherein at least one of the population of absorbent mats at least partially overlaps another one of the population of absorbent mat to form a layer of absorbent mats.

Another embodiment of the present invention is directed to an absorbent floor system for absorbing oil, grease, coolant and/or other fluids wherein overlapped absorbent mats are secured to one another by double sided hook fasteners.

Another embodiment of the present invention is directed to an absorbent floor system for absorbing oil, grease, coolant and/or other fluids comprising a population of single sided hook fasteners adhered to a floor of a manufacturing facility wherein the population of single sided hook fasteners define at least one mat-hook-floor line of the absorbent floor system; a population of absorbent mats comprising at least one inner absorbent mat and at least one outer most absorbent mat wherein at least one outer most absorbent mat is secured directly to at least one of the population of one or more single sided hook fasteners and wherein the at least one inner absorbent mat is placed under the at least one outer most absorbent mat and is secured to the at least one outer most absorbent mat by a double sided hook fastener Another embodiment of the present invention is directed to a method of installing an absorbent floor system for absorbing oil, grease, coolant and/or other fluids comprising a population of absorbent mats comprising the steps of: placing a population of absorbent mats on the floor of a manufacturing facility; adhering a population of single sided hook fasteners to the floor, wherein the population of single sided hook fasteners define a mat-hook-floor line of the absorbent floor system; and securing one or more of the population of absorbent mats directly to the population of single sided hook fasteners.

Another embodiment of the present invention is directed to a method of installing an absorbent floor system for absorbing oil, grease, coolant and/or other fluids comprising a population of absorbent mats comprising the steps of: placing inner absorbent mats on a floor of a manufacturing facility and/or partially or completely overlapping any previously placed inner absorbent mats, wherein the inner absorbent mats may be a standard absorbent mat, a leaner absorbent mat, a pre-site custom cut absorbent mat, a pre-site custom cut walkway absorbent mat, and/or a most traveled walkway absorbent mat; placing outer most absorbent mats on the floor and/or partially or completely overlapping any previously placed inner or outer most absorbent mats, wherein the outer most absorbent mats may be a standard absorbent mat, a leaner absorbent mat, a pre-site custom cut absorbent mat, a pre-site custom cut walkway absorbent mat, and/or a most traveled walkway absorbent mat; adhering a population of single sided hook fasteners to the floor wherein the population of single sided hook fasteners define a mat-hook-floor line of the absorbent floor system; and securing the outer most absorbent mats directly to the population of single sided hook fasteners.

BRIEF DESCRIPTION OF THE FIGURES

These and other features, aspects and advantages of the invention will become more fully apparent from the following detailed description, appended claims, and accompanying drawings, wherein the drawings illustrate features in accordance with exemplary embodiments of the present invention, and wherein:

DETAILED DESCRIPTION OF THE INVENTION

Figure 1:
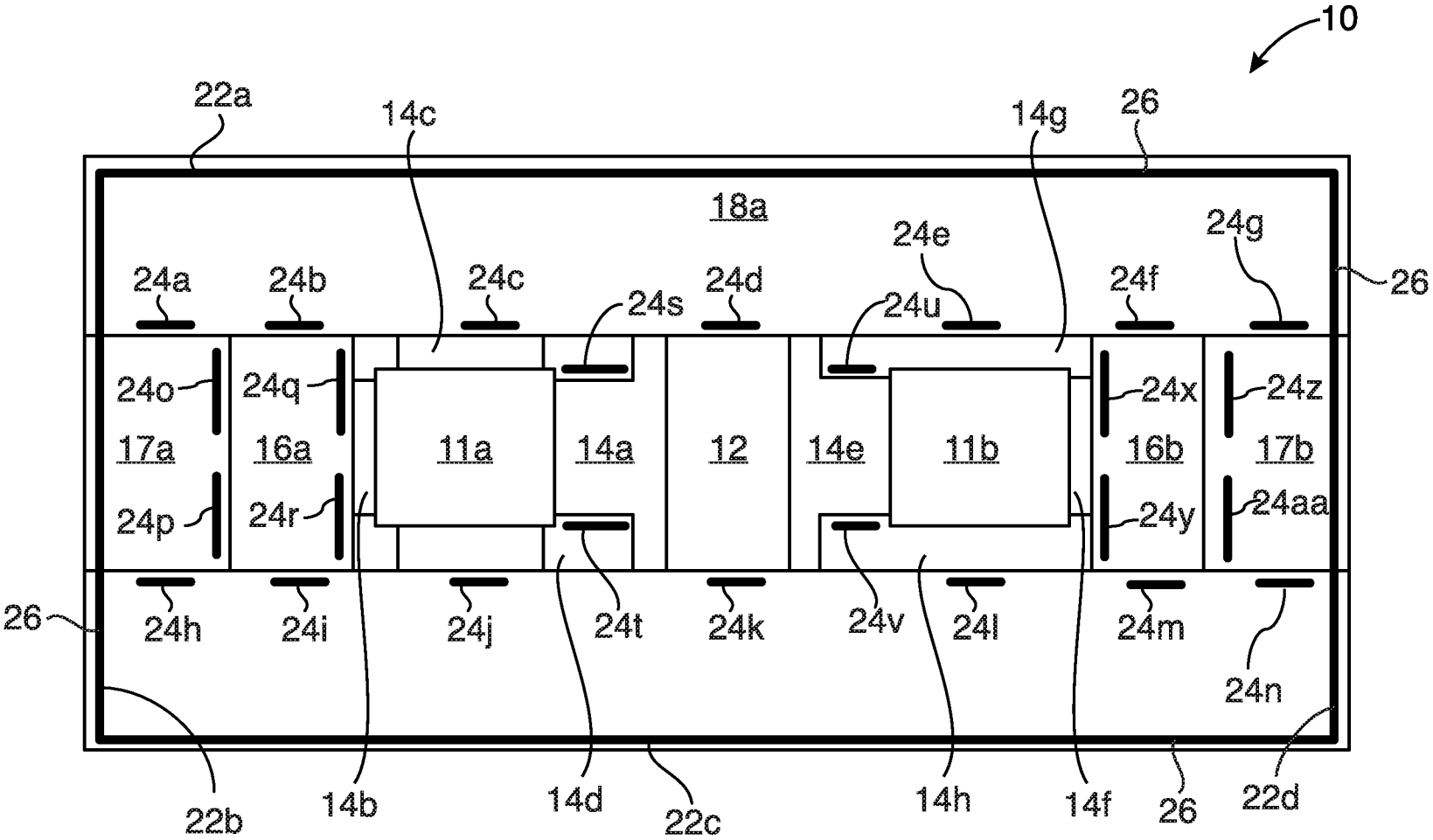
FIG. 1 is a top view of a population of absorbent mats of an absorbent floor system according to a first embodiment of the present invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the objects listed thereafter and equivalents thereof as well as additional objects. All numbers expressing measurements and so forth used in the specification and claims are to be understood as being modified in all instances by the term "about."

Absorbent mats are used in absorbent floor systems of the invention. In one embodiment, all mats of the absorbent floor system include the same absorbent material. In other embodiments, the absorbent materials differ among the mats of an absorbent floor system. For example, absorbent materials may be selected based on a variety of factors including, but not limited to, the quantity and/or flow of oil, grease, coolant and/or other fluids to be absorbed; the length of time that the absorbent floor system is to be in service prior to a reinstall; the level of actual or anticipated foot traffic over the absorbent floor system; available sizes of absorbent mats; the size of the area to be covered; whether the area to be covered is sloped or level, and/or other factors. Absorbent mats of an absorbent floor system may comprise a needle-punched polypropylene-synthetic blend material. In certain embodiments, absorbent mats of an absorbent floor system comprise at least 20 percent polypropylene. In certain other embodiments, absorbent mats of an absorbent floor system comprise at least 50 percent polypropylene. In yet other embodiments, absorbent mats of an absorbent floor system comprise at least 60 percent polypropylene. In yet other embodiments, absorbent mats of an absorbent floor system comprise about 100 percent polypropylene. In certain embodiments, therefore, absorbent mats of an absorbent floor system comprise from about 20 to 100 percent polypropylene and from about zero to about 80 percent other synthetic or natural materials, wherein the other synthetic materials may include, but are not limited to, polyester, polyethylene, rubber, and/or other synthetic or natural materials suitable for use in an absorbent mat, e.g., because such materials exhibit characteristics of absorbency, durability and/or flexibility (defined as how easily the mat can be folded, rolled, and/or bent) similar to polypropylene or otherwise suitable for use in an absorbent mat. Such other synthetic or natural materials may also include fire retardants, UV stabilizers or inhibitors, colorants, binders, adhesives, antistatic materials, antimicrobial materials, and/or other additives that provide qualities useful for absorbent mats of absorbent floor systems of the invention.

For example, in one embodiment, an absorbent mat of an absorbent floor system comprises about 20 percent polypropylene and about 80 percent other synthetic or natural materials. In another embodiment, an absorbent mat of an absorbent floor system comprises about 30 percent polypropylene and about 70 percent other synthetic or natural materials. In other embodiments, an absorbent mat of an absorbent floor system comprises (i) about 40 percent polypropylene and about 60 percent other synthetic or natural materials; (ii) about 50 percent polypropylene and about 50 percent other synthetic or natural materials; (iii) about 60 percent polypropylene and about 40 percent other synthetic or natural materials; (iv) about 70 percent polypropylene and about 30 percent other synthetic or natural materials; (v) about 80 percent polypropylene and about 20 percent other synthetic or natural materials; (vi) about 90 percent polypropylene and about 10 percent other synthetic or natural materials; (v) about 100 percent polypropylene (it being understood that a mat comprising about 100 percent polypropylene absorbent mat may also include other synthetic or natural materials such as fire retardants, UV stabilizers or inhibitors, colorants, binders, adhesives, antistatic materials, antimicrobial materials and/or other materials suitable for use in absorbent mats of absorbent floor systems).

In a preferred embodiment, the absorbent mat is a needle punched and heat treated industrial fabric having a composition of about 99.65 percent polypropylene and about 0.35 percent carbon black colorant bound in the polymer matrix. Such absorbent mat may be supplied by Dalco Nonwovens, LLC of Conover, N.C. under the product names I100-BLK160-144-150 or I100-HGY160-036-150.

Absorbent mats of absorbent floor systems of the invention may be further defined by the weight of the mat. The weight of an absorbent mat is defined on a weight per area basis (e.g., ounces per square yard). For example, an absorbent mat may weigh from about 8 ounces to about 30 ounces per square yard (e.g., about 8 ounces, about 10 ounces, about 12 ounces, about 14 ounces, about 15 ounces, about 16 ounces, about 18 ounces, about 20 ounces, about 22 ounces, about 24 ounces, about 26 ounces, about 28 ounces, or about 30 ounces per square yard). In another embodiments, an absorbent mat of an absorbent floor system weighs from about 10 ounces to about 20 ounces per square yard. In yet another embodiment, an absorbent mat of an absorbent floor system weighs about 15 ounces per square yard.

In addition to the variety of material types and weights of absorbent mat contemplated by various embodiments, absorbent mats of varying widths may be utilized in the absorbent floor system. In one embodiment, absorbent mats of an absorbent floor system vary in width from about 2 feet to about 13 feet. For example, one or more absorbent mats are about 2 feet wide, about 3 feet wide, about 4 feet wide, about 5 feet wide, about 6 feet wide, about 7 feet wide, about 8 feet wide, about 9 feet wide, about 10 feet wide, about 11 feet wide, about 12 feet wide, and/or about 13 feet wide. Absorbent mats may be provided from the manufacturer in 150 foot (50 yard) rolls and cut to any desired length and/or width; absorbent mats may be otherwise provided.

FIG. 1 illustrates one embodiment of the absorbent floor system 10 as installed in a manufacturing facility. In this particular embodiment, two objects 11*a* and 11*b* are present on the manufacturing facility floor and may be work tables, machinery, railings, posts, etc. around which the absorbent floor system is installed. The absorbent floor system 10 comprises absorbent mats 12, 14*a*, 14*b*, 14*c*, 14*d*, 14*e*, 14*f*, 14*g*, 14*h*, 16*a*, 16*b*, 17*a*, 17*b*, 18*a* and 18*b* with features of absorbent mats of absorbent floor systems described above. In this embodiment, absorbent mat 12 is provided on-site as a standard absorbent mat and installed without on-site cuts. Standard absorbent mat refers to a mat in a size used commonly enough to justify pre-cutting absorbent mats to such sizes. The sizes of standard absorbent mats of any particular absorbent floor system may vary based on the system. In one embodiment, standard mat sizes are about 3 feet by about 10 feet, about 18 inches by about 18 inches, about 18 inches by about 3 feet, about 18 inches by about 6 feet, about 2 feet by about 3 feet, and/or about 3 feet by about 6 feet. Standard absorbent mats may also be placed in high usage areas, as described more fully elsewhere herein. Some embodiments of absorbent floor systems do not include standard absorbent mats.

Leaner absorbent mats 14*a*, 14*b*, 14*c*, 14*d*, 14*e*, 14*f*, 14*g*, 14*h* are placed around and under objects 11*a* and 11*b* and overlap standard absorbent mat 12. Leaner absorbent mats 14*a*, 14*b*, 14*c*, 14*d*, 14*e*, 14*f*, 14*g*, 14*h* are absorbent mats custom cut on site (i.e., the installation site) to allow the mat to lie substantially flat around and under an object adjacent to the mat, as described more fully below. A leaner mat may be provided on-site as a standard absorbent mat (e.g., in one of the sizes used commonly enough to justify pre-cutting mats to such sizes without consideration of information gathered during site evaluation and planning) or as a pre-site custom cut absorbent mat (described below). Other types of absorbent mats may be placed under objects 11*a* and 11*b*. Some embodiments of absorbent floor systems do not include leaner absorbent mats.

Absorbent mats 16*a* and 16*b* are pre-site custom cut absorbent mats that overlap leaner absorbent mats 14*b*, 14*c*, 14*d* and 14*f*, 14*g*, 14*h*, respectively, as described more fully elsewhere herein. In the embodiment of an absorbent floor system 10 illustrated on FIG. 1, absorbent mats 17*a* and 17*b* are pre-site custom cut walkway mats placed on the floor that overlap pre-site custom cut absorbent mats 16*a* and 16*b*, respectively, as described more fully elsewhere herein. Pre-site custom cut absorbent mats refer to absorbent mats sized based on site evaluation and planning applicable to a particular absorbent floor system. In general, a pre-site custom cut absorbent mat is an absorbent mat that is not a standard absorbent mat or a leaner mat (although, as noted above, a leaner absorbent mat can originate as a pre-site custom cut absorbent mat). Some embodiments of absorbent floor systems do not include pre-site custom cut absorbent mats.

In this embodiment, absorbent mats 18*a* and 18*b* are most traveled walkway mats 18*a* and 18*b* and are placed on the floor, wherein most traveled walkway mat 18*a* overlaps standard absorbent mat 12, leaner absorbent mats 14*a*, 14*b*, 14*c*, 14*e*, 14*f* and 14*g*, pre-site custom cut absorbent mats 16*a* and 16*b*, and pre-site custom cut walkway absorbent mats 17*a* and 17*b*, and wherein most traveled walkway mat 18*b* overlaps standard absorbent mat 12, leaner absorbent mats 14*a*, 14*b*, 14*d*, 14*f* and 14*h*, pre-site custom cut absorbent mat 16*a* and 16*b*, and pre-site custom cut walkway absorbent mats 17*a* and 17*b*, as described more fully elsewhere herein.

Most traveled walkway mat refers to a mat used in a high foot traffic or relatively high foot traffic portion of the area covered by an absorbent floor system. The significance of the designation of an absorbent mat of an absorbent floor system as a most traveled walkway mat is found primarily in installation of the system. As described in more detail below, according to a preferred method of installing an absorbent floor system, a most traveled walkway absorbent mat is the first mat to be secured to the floor. Furthermore, a most traveled walkway mat is often placed immediately adjacent to non-work area walkways, e.g., a walkway used for visitors to a factory floor. A most traveled walkway absorbent mat may be provided as a pre-site custom cut absorbent mat or a standard absorbent mat. In some embodiments, a most traveled walkway absorbent mat may also be a leaner absorbent mat. Other embodiments include no most traveled walkway mats.

Although pre-site custom cut walkway absorbent mats 17*a* and 17*b* and most traveled walkway absorbent mats 18*a* and 18*b* are shown as the outer most absorbent mats, in other embodiments, pre-site custom cut walkway absorbent mats 17*a* and 17*b* and most traveled walkway absorbent mats 18*a* and 18*b* may be inner absorbent mats. In one embodiment, for example, a most traveled walkway absorbent mat or pre-site custom cut walkway absorbent mat may run through an inner region of an absorbent floor system and be surrounded by a population of underlapping mats. In another embodiment, for example, a most traveled walkway absorbent mat or pre-site custom cut walkway absorbent mat may run through the middle of an absorbent floor system and be surrounded by a population of underlapping mats.

All absorbent mats 12, 14*a*, 14*b*, 14*c*, 14*d*, 14*e*, 14*f*, 14*g* 14*h*, 16*a*, 16*b*, 17*a*, 17*b*, 18*a* and 18*b* may be made of the same material, e.g., 15 ounce weight of 50 percent polypropylene and 50 percent other natural or synthetic materials. Alternatively, absorbent mats 12, 14*a*, 14*b*, 14*c*, 14*d*, 14*e*, 14*f*, 14*g* 14*h*, 16*a*, 16*b*, 17*a*, 17*b*, 18*a* and 18*b* may be made of different materials, e.g., in one embodiment standard absorbent mat 12 and leaner absorbent mats 14*a*, 14*b*, 14*c*, 14*d*, 14*e*, 14*f*, 14*g* and 14*h* are made of a 16 ounce weight of about 100 percent polypropylene; and pre-site custom absorbent mats 16*a* and 16*b*, pre-site custom walkway absorbent mats 17*a* and 17*b*, and most traveled walkway absorbent mats 18*a* and 18*b* are made of a 20 ounce weight of 60 percent polypropylene and 40 percent other natural or synthetic materials. Other variations of weights and blends as described herein can be used for absorbent mats of embodiments of the absorbent floor system. In certain embodiments, absorbent mats with a higher ounce weight and/or a higher percentage of polypropylene are selected for areas expected to receive higher amounts of oil, grease, coolant and/or other fluids and absorbent mats with a lower weight and/or lower percentage of polypropylene are selected for areas expected to receive smaller amounts of oil, grease, coolant, and/or other fluids, such as areas expected to receive only light mistings of such fluids.

In some embodiments of an absorbent floor system, multiple layers of absorbent mats are provided, e.g., an additional absorbent mat (not shown) may be placed above or below all or part of standard absorbent mat 12, leaner absorbent mats 14*a*, 14*b*, 14*c*, 14*d*, 14*e*, 14*f*, 14*g* and 14*h*, pre-site custom cut absorbent mats 16*a* and 16*b*, pre-site custom cut walkway absorbent mats 17*a* and 17*b*, and/or most traveled walkway absorbent mats 18*a* and 18*b*. The additional layers of absorbent mats may be placed in areas of high usage or high flows of oil, grease, coolant and/or other fluids and these additional absorbent mats may or may not be secured to any overlapping absorbent mats. The multiple layers of absorbent mats may provide cushioning for persons walking on the absorbent floor system 10 such that a separate cushion layer is not required.

Absorbent floor system 10 further comprises single sided hook fasteners 22 and double sided hook fasteners 24. The outer most absorbent mats, which as shown in FIG. 1 are most traveled walkway mats 18*a* and 18*b* and pre-site custom cut walkway mats 17*a* and 17*b*, are secured to the floor using single sided hook fasteners 22*a*-22*d*. One or more or all of the overlapping absorbent mats are secured to or interlocked with one another using double sided hook fasteners 24*a*-24*aa*. In FIG. 1, single sided hook fasteners 22*a*-22*d* and double sided hook fasteners 24*a*-24*aa* are shown on top of all the absorbent mats for ease of illustration as to their possible locations; however in use, single sided hook fasteners 22*a*-22*d* and double sided hook fasteners 24*a*-24*aa* are under and/or between the absorbent mats.

In some embodiments of absorbent floor systems of the present invention, absorbent mats of an absorbent floor system are secured or attached to the floor of the manufacturing facility or are secured to or interlocked with other absorbent mats using the hook fastener portion of a hook-and-loop type fastener (e.g., Velcro®-brand). Preferred materials for absorbent mats of absorbent flooring systems of the invention function as the loop portion of a hook-and-loop fastener and, accordingly, the hook fastener portion connects directly to the absorbent mats of such embodiments of absorbent flooring systems. In other embodiments, the loop fastener portion may be secured to an absorbent mat to permit an absorbent mat to be secured to the floor or underlying mat via a hook fastener.

Heavy duty hook fasteners are preferred. In one example embodiment, the hook fastener is supplied by Grimco Inc. of Fenton, Mo. Hook fasteners of varying widths may be utilized in the absorbent floor system. In one embodiment, for example, the hook fasteners may be about vary in width from about 0.5 inches to about 3.0 inches (e.g., about 0.5 inches wide, about 0.75 inches wide, about 1.0 inch wide, about 1.25 inches wide, about 1.5 inches wide, about 1.75 inches wide, about 2.0 inches wide, about 2.25 inches wide, about 2.5 inches wide, about 2.75 inches wide, about 3.0 inches wide). In other embodiments, the hook fasteners may vary in width from about 0.75 inches to about 1.5 inches. In yet another embodiment, the hook fasteners are about 0.75 inches wide. In yet another embodiment, the hook fasteners are about 2.0 inches wide. In yet another embodiment, the hook fasteners are more than 3.0 inches wide. Typically, the hook fasteners are provided in 75 feet (25 yard) rolls; however the hook fasteners may be cut to any desired length. In certain embodiments, for example, the hook fasteners may be about 3.0 inches in length or longer (e.g., about 3.0 inches, about 6.0 inches, about 12 inches, about 18 inches, about 2 feet, about 6 feet, about 12 feet, about 24 feet, about 50 feet, or about 75 feet).

In certain embodiments, as shown in FIG. B, single sided hook fasteners 22 comprise a substantially smooth first surface (e.g., a bottom) 22' and a second surface comprising a population of hooks (e.g., a top) 22". Single sided hook fasteners may be supplied with an adhesive on the first surface that permits securing of the single sided hook fastener to a floor 28. In other embodiments, the first surface of a single sided hook fastener may be adhered to a floor using a variety of adhesives applied to the first surface and/or the floor 28 during installation of the absorbent floor system including, but not limited to, rubber cement, epoxy, cyanoacrylate, etc. In yet other embodiments, single sided hook fasteners may be secured to the floor 28 using a variety of means including, but not limited to screws, nails, rivets, etc.

Figure 1A:
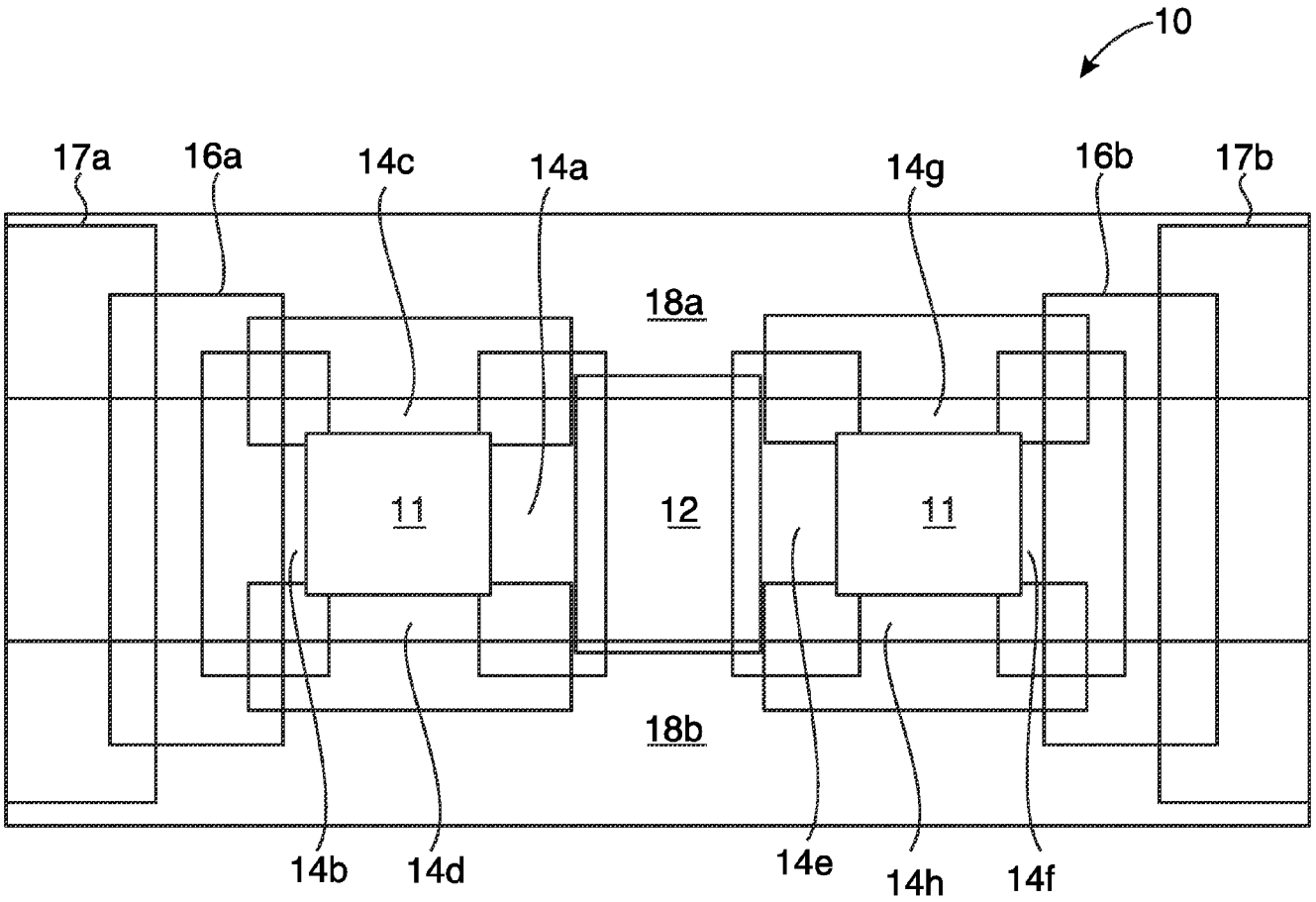
FIG. 1A is a top view of a population of absorbent mats of an absorbent floor system showing the absorbent mats overlapping each other according to the first embodiment of the present invention.
Figure 1B:
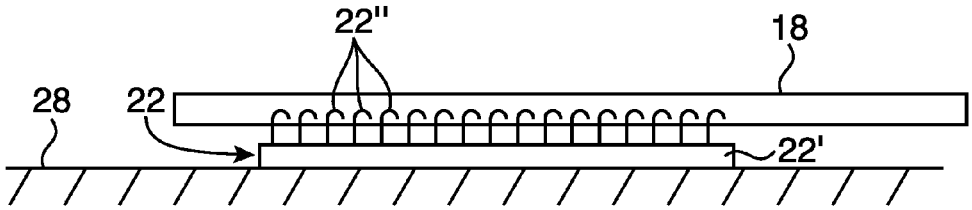
FIG. 1B is a side view of a single sided hook fastener adhered to a floor and connected to an absorbent mat.
Figure 1C:
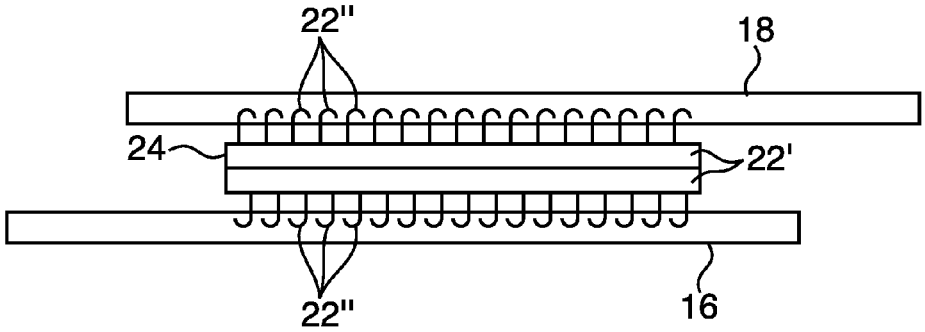
FIG. 1C is a side view of a double sided hook fastener connected to two absorbent mats.

In one embodiment, as shown in FIG. 1C, double sided hook fasteners 24 may be constructed of two pieces of single sided hook fasteners 22 with the two first surfaces (the non-hooked surfaces) 22' adhered to one another using the adhesive on the first surface of the single sided hook fastener as supplied. In other embodiments, the two first surfaces (the non-hooked surfaces) may be adhered to one another using a variety of adhesives including, but not limited to, rubber cement, epoxy, cyanoacrylate, etc. In other embodiments, double sided hook fasteners may be specifically manufactured as a single piece having hook fasteners on both first and second surfaces.

As illustrated in FIG. 1, single sided hook fasteners 22*a*-22*d* are shown as long continuous pieces of single sided hook fasteners; however in other embodiments, the single sided hook fasteners may be shorter or longer in length and any number of single sided hook fasteners may be used based on the requirements of the particular absorbent floor system. Additionally, double sided hook fasteners 24*a*-24*aa* are shown as shorter pieces of double sided hook fasteners; however in other embodiments, the double sided hook fasteners may be shorter or longer in length and any number of double sided hook fasteners may be used based on the requirements of the particular absorbent floor system. While the majority of the overlapping absorbent mats in FIG. 1 are shown as being secured to or interlocked with one another using double sided hook fasteners, in certain embodiments all overlapping mats may be secured or interlocked with one another using double sided hook fasteners. In other embodiments, less than all overlapping absorbent mats may be secured or interlocked with one another. Accordingly, the number, length, and placement of double sided hook fasteners and the number of overlapping absorbent mats that are secured or interlocked with one another using double sided hook fasteners may be based on the requirements of the particular absorbent floor system.

In this particular embodiment, the single sided hook fasteners 22*a*-22*d* are not placed right at the outer edges of outer most absorbent mats, wherein the outer most absorbent mats as shown in FIG. 1 are most traveled walkway absorbent mats

18*a* and 18*b* and pre-site custom cut walkway absorbent mats 17*a* and 17*b*. The lines created by single sided hook fasteners 22*a*-22*d* are considered the mat-hook-floor lines 26, wherein, as shown in FIG. 1B, the mat-hook-floor lines 26 have a width equal to the width of the single sided hook fasteners 22*a*-22*d*. The single sided hook fasteners 22*a*-22*d* are placed such that the outer most absorbent mats 18 extend beyond the mat-hook-floor lines 26: as shown in FIG. Similarly, the double sided hook fasteners 24*a*-24*aa* are not placed right at the outer edges of the overlapping absorbent mats 12, 14*a*-14*h*, 16*a*, 16*b*, 17*a*, 17*b*, 18*a* and 18*b*. The lines created by double sided hook fasteners 24*a*-24*aa* are considered the "mat-hook-mat lines," wherein the mat-hook-mat lines have a width equal to the width of the double sided hook fasteners 24*a*-24*aa*. The double sided hook fasteners 24*a*-24*aa* are placed such that the overlapping absorbent mats 12, 14*a*-14*h*, 16*a*, 16*b*, 17*a*, 17*b*, 18*a* and 18*b* extend beyond the mat-hook-mat lines.

Figure 2:
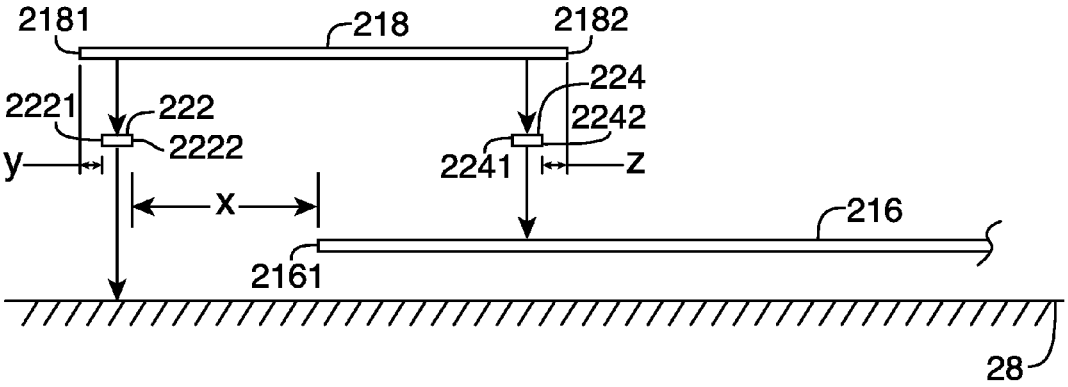
FIG. 2 is an exploded side view of a portion of an absorbent floor system according to an embodiment of the present invention.

The extension of the absorbent mats beyond the mat-hook-floor lines and the mat-hook-mat lines is shown in more detail in FIG. 2. In this embodiment, pre-site custom cut absorbent mat 216 is placed on a floor and most traveled walkway mat 218 is placed on the floor and partially overlaps pre-site custom cut absorbent mat 216. A single sided hook fastener 222 having a first surface that is substantially smooth and a second surface that has a population of hooks is used to attach most traveled walkway absorbent mat 218 to the floor. The first surface of single sided hook fastener 222 is adhered to the floor and absorbent mat 218 is attached or secured to the second surface of single sided hook fastener 222. Single sided hook fastener 222 has a first edge 2221 and a second edge 2222 defined by the width of single sided hook fastener 222. First edge 2221 and second edge 2222 also define the width of the mat-hook-floor line. A double sided hook fastener 224 which has hook fasteners on both a first and second surface (e.g., a top and a bottom) is used to secure or interlock the overlapping portions of pre-site custom absorbent mat 216 and most traveled walkway mat 218. Double sided hook fastener 224 has a first edge 2241 and a second edge 2242 defined by the width of double sided hook fastener 224. First edge 2241 and second edge 2242 also define the width of the mat-hook-mat line. Pre-site custom cut mat 216, most traveled walkway mat 218 and single sided hook fastener 222 are placed such that first edge 2161 of pre-site custom cut mat 216 is a sufficient distance (x) within second edge 2222 of single sided hook fastener 222 so as to reduce any ridges in the overlapping absorbent mats and therefore may reduce or eliminate potential tripping points. The distance (x) that first edge 2161 of pre-site custom cut mat 216 is within second edge 2222, and thus from the mat-hook-floor line, may be any sufficient distance to reduce or eliminate potential tripping points. In certain embodiments, distance (x) from first edge 2161 to second edge 2222, and thus from the mat-hook-floor line, may vary from about 2.0 inches to more than 3.0 inches (e.g., about 2.0 inches, about 2.25 inches, about 2.5 inches, about 2.75 inches, about 3.0 inches, about 3.25, about 3.5 inches, about 3.75 inches, about 6 inches, about 12 inches). In other embodiments, distance (x) from first edge 2161 to second edge 2222, and thus from the mat-hook-floor line, is at least 3.0 inches. In yet other embodiments, distance (x) from first edge 2161 to second edge 2222, and thus from the mat-hook-floor line, is at least 3.5 inches. In yet other embodiments, distance (x) from first edge 2161 to second edge 2222, and thus from the mat-hook-floor line, is at least 6.0 inches.

If single sided hook fastener 222 was placed so that first edge 2221 coincided with first edge 2181 of the most traveled walkway absorbent mat 218 the combined thickness of the single sided hook fastener 222 and the most traveled walkway absorbent mat 218 might be high enough to cause someone to trip. Accordingly, single sided hook fastener 222 may be placed under most traveled walkway mat 218 such that first edge 2181 of most traveled walkway absorbent mat 218 extends a sufficient distance (y) beyond first edge 2221 of single sided hook fastener 222 so as to allow the first edge 2181 of most traveled walkway absorbent mat 218 to lie directly on the floor so that there is a gentle transition in thickness from the thickness of the most traveled walkway absorbent mat 218 to the combined thickness of the most traveled walkway absorbent mat 218 and the single sided hook fastener 222. This may reduce or eliminate potential tripping points. In some embodiments, the distance (y) from first edge 2181 to first edge 2221, and thus from the mat-hook-floor line, is about 0.125 inches. In other embodiments distance (y) is from about 0.125 inches to about 1.0 inch (e.g., about 0.125 inches, about 0.25 inches, about 0.375 inches, about 0.5 inches, about 0.625 inches, about 0.75 inches, about 0.875 inches, or about 1.0 inch). In other embodiments, the distance (y) from first edge 2181 to first edge 2221, and thus from the mat-hook-floor line, is between about 0.25 inches and about 0.75 inches. In yet other embodiments, the distance (y) from first edge 2181 to first edge 2221, and thus from the mat-hook-floor line, is about 0.5 inches. In yet other embodiments, the distance (y) from first edge 2181 to first edge 2221, and thus from the mat-hook-floor line, is less than 0.125 inches. That is, in some embodiments, the first edge 2221 of single sided hook fasteners 222 may be placed at first edge 2181 of most traveled walkway absorbent mat 218 such that first edge 2221 and first edge 2181 are collinear. This may be done where there is little or no traffic crossing over single sided hook fasteners 222 such that there is a low likelihood of someone tripping.

If double sided hook fastener 224 were placed so that second edge 2242 coincided with second edge 2182 of the most traveled walkway absorbent mat 218 the combined thickness of the double sided hook fastener 224 and the most traveled walkway absorbent mat 218 might be high enough to cause someone to trip. Accordingly, double sided hook fastener 224 may be placed under most traveled walkway mat 218 and over pre-site custom cut mat 216 such that second edge 2182 of most traveled walkway absorbent mat 218 extends a sufficient distance (z) beyond second edge 2242 of double sided hook fastener 224 so as to allow the second edge 2182 of most traveled walkway absorbent mat 218 to lie directly on the pre-site custom cut absorbent mat 216 so that there is a gentle transition in thickness from the thickness of pre-site custom cut absorbent mat 216 to the combined thickness of most traveled walkway absorbent mat 218 and double sided hook fastener 224. This may reduce or eliminate potential tripping points. The distance (z) from second edge 2182 to second edge 2242, and thus from the mat-hook-mat line, may vary from about 0.125 inches to about 1.0 inch (e.g., about 0.125, about 0.25 inches, about 0.375 inches, about 0.5 inches, about 0.625 inches, about 0.75 inches, about 0.875 inches, or about 1.0 inch). In other embodiments, the distance (z) from second edge 2182 to second edge 2242, and thus from the mat-hook-mat line, may vary from about 0.25 inches to about 0.75 inches. In yet other embodiments, the distance (z) from second edge 2182 to second edge 2242, and thus from the mat-hook-mat line, may be about 0.5 inches. In yet other embodiments, the distance (z) from second edge 2182 to second edge 2242, and thus from the mat-hook-mat line, is less than 0.125 inches. That is, in some embodiments, the second edge 2242 of double sided hook fasteners 224 may be placed at second edge 2182 of most traveled walkway absorbent mat 218 such that second edge 2242 and second edge 2182 are collinear. This may be done where there is little or no traffic crossing over double sided hook fasteners 224 such that there is a low likelihood of someone tripping.

While the references in FIG. 2 are to most traveled walkway absorbent mat 218 and pre-site custom cut absorbent mat 216, it is to be understood that the placement of absorbent mats and single sided hook fasteners and double sided hook fasteners can be similar for any absorbent mat that is an outer most absorbent mat and for any absorbent mats that overlap.

Referring again to FIG. 1, while the single sided hook fasteners 22*a*-22*d* are shown only on the outer most absorbent mats of the absorbent floor system, single sided hook fasteners are not limited to this portion. In certain embodiments, for example, single sided hook fasteners may be used on inner absorbent mats of the absorbent floor system depending on the requirements of the particular installation of the absorbent floor system. Additionally, while the double sided hook fasteners 24*a*-24*aa* are shown on the inner absorbent mats of the absorbent floor system, double sided hook fasteners are not limited to this portion. In certain embodiments, for example, double sided hook fasteners may be used on outer most absorbent mats of the absorbent floor system depending on the requirements of the particular installation of the absorbent floor system. In one embodiment, for example, an absorbent mat may be 3 feet wide and 20 feet long and one or more single sided hook fasteners may be run down the middle of the absorbent mat, wherein the one or more single sided hook fasteners run parallel with the 20 foot long sides of the absorbent mat and 18 inches in from the 20 foot long sides of the absorbent mat. This absorbent mat may be a most traveled walkway absorbent mat.

In certain other embodiments, one or more additional single sided hook fasteners may be used where there is not a significant number of overlapping mats. Accordingly, single sided hook fasteners and double sided hook fasteners can be used in any number and any location in the absorbent floor system depending on the requirements of the particular installation of the absorbent floor system to ensure that tripping points are minimized or eliminated.

Figure 3A:
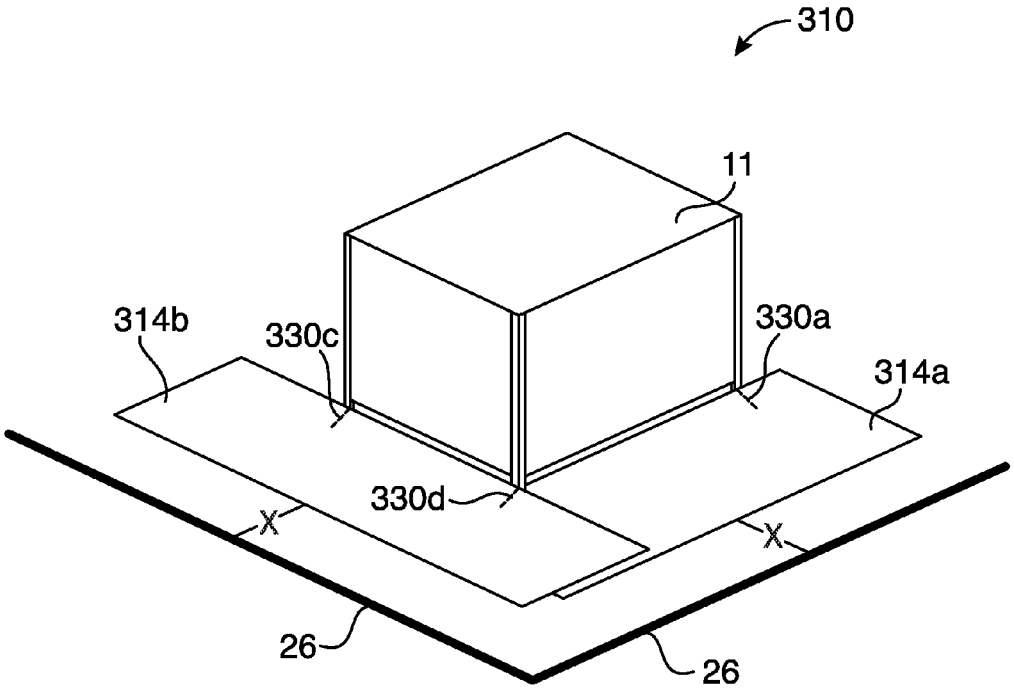
FIG. 3A is a perspective view of an absorbent floor system according to a second embodiment of the present invention.
Figure 3B:
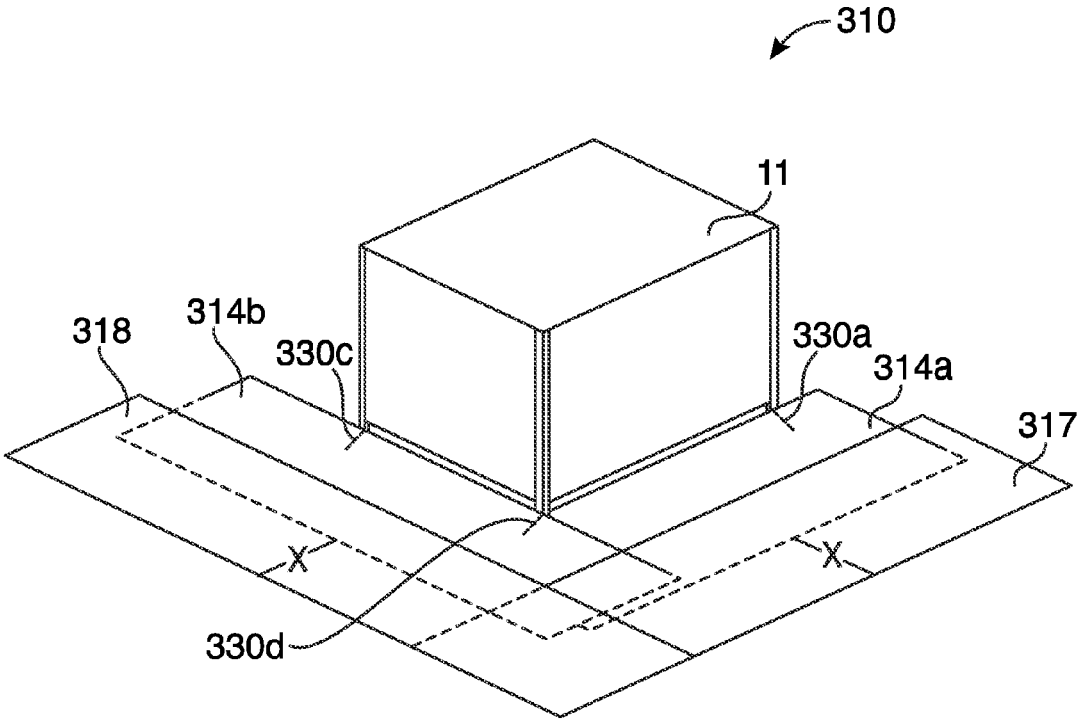
FIG. 3B is a perspective view of an absorbent floor system according to the second embodiment of the present invention.
Figure 4:
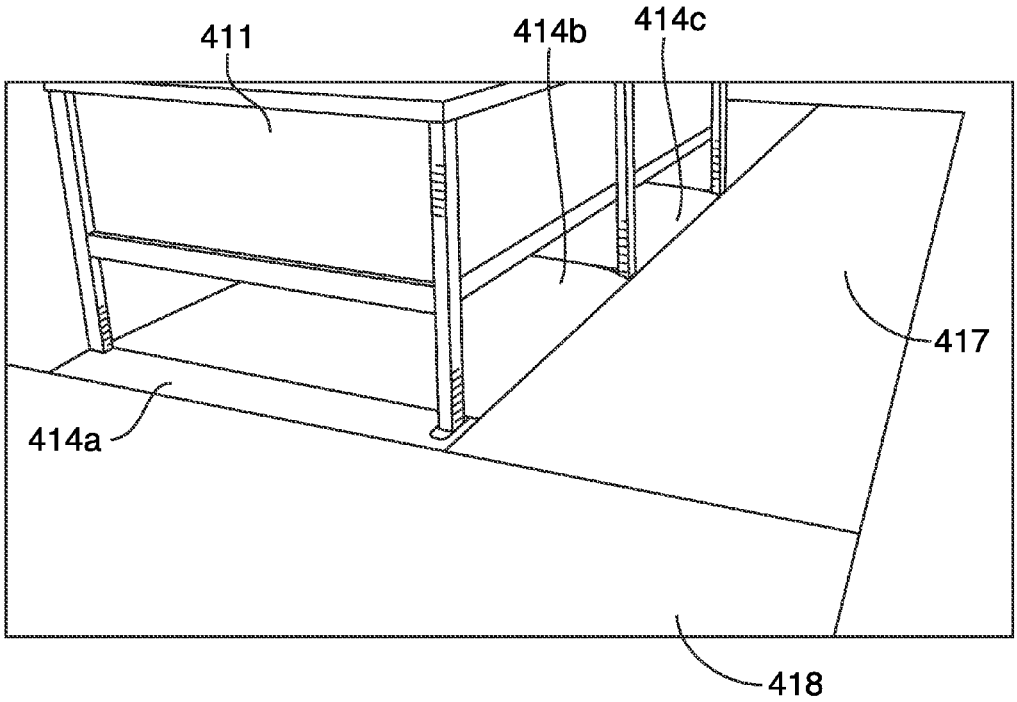
FIG. 4 is a perspective view of a portion of an absorbent floor system wherein leaner absorbent mats are laying flat on a floor and under an object according to an embodiment of the present invention.

Other absorbent floor systems do not include all types of absorbent mats of absorbent floor system 10. For example, FIGS. 3A and 3B show absorbent floor system 310 comprising only leaner absorbent mats 314*a* and 314*b*, a pre-site custom cut absorbent walkway mat 317 and a most traveled walkway mat 318. FIG. 3A illustrates leaner absorbent mat 314*a* placed on the floor around object 11 and leaning against object 11. Leaner absorbent mat 314*b* is placed on the floor around object 11 and leaning against object 11, wherein leaner absorbent mat 314*b* also partially overlaps leaner absorbent mat 314*a*. Leaner absorbent mats 314*a* and 314*b* will be cut along the dotted lines 330*a*, 330*b*, and 330*c* (not shown), 330*d*, respectively, as described more fully elsewhere herein, to accommodate the legs of item 11 such that leaner absorbent mats 314*a* and 314*b* can lie substantially flat around and under object 11 to absorb any potential oil, grease, coolant and/or other fluids from object 11. FIG. 3A further illustrates that the sides of leaner absorbent mats 314*a* and 314*b* are sufficient distance (x) within the mat-hook-floor line, as described more fully elsewhere herein. FIG. 3B shows pre-site custom cut absorbent mat 317 placed on the floor and partially overlapping leaner absorbent mats 314*a* and 314*b*. Most traveled walkway absorbent mat 318 is placed on the floor and partially overlaps leaner absorbent mats 314*a* and 314*b* and pre-site custom cut walkway mat 317. Pre-site custom cut absorbent mat 317 and most traveled walkway absorbent mat 318 are secured to the floor along mat-hook-floor line using single sided hook fasteners (not shown), as described more fully elsewhere herein. One or more or all of the overlapping absorbent mats may be secured to or interlocked with one another using double sided hook fasteners (not shown). Referring now to FIG. 4, an embodiment of the absorbent floor system is shown where leaner absorbent mats 414*a*-414*c* have been custom cut on-site to lie substantially flat on the floor and under object 411. Pre-site custom cut walkway absorbent mat 417 and most traveled walkway absorbent mat 418 are then shown overlapping all or part of leaner absorbent mats 414*a*-414*c*.

Another example embodiment of an absorbent floor system comprises pre-site custom cut absorbent mats, pre-site custom cut walkway absorbent mats, and most traveled walkway mats. Yet another embodiment comprises pre-site custom cut walkway absorbent mats and most traveled walkway absorbent mats. A further embodiment comprises standard absorbent mats, pre-site custom cut absorbent mats, pre-site custom cut walkway absorbent mats, and most traveled walkway absorbent mats. In other embodiments, an absorbent floor system comprises (1) standard absorbent mats, pre-site custom cut walkway absorbent mats, and most traveled walkway absorbent mats; or (2) standard absorbent mats, leaner absorbent mats, pre-site custom cut walkway absorbent mats, and most traveled walkway absorbent mats.

As will be understood, a most traveled walkway absorbent mat may be used in a location that is not actually the most traveled walkway of a particular site. Rather, "most traveled walkway mat" refers to a mat selected based on an actual or anticipated high traffic volume in all or part of the area covered by the mat.

While the absorbent mats are shown disposed at substantially right angles from each other, the absorbent mats can be placed at any angle and an absorbent floor system can form any shape on the floor including, but not limited to, triangular, rectangular, square, pentagonal, hexagonal, octagonal, circular, etc. Additionally, in certain embodiments, for example, the absorbent mats can be installed such that an absorbent floor system is irregular in shape. An absorbent floor system can be installed in any shape as desired or recommended in order to provide adequate absorption a variety of materials including, but not limited to, oil, grease, coolant, and/or other fluids.

Figure 5:
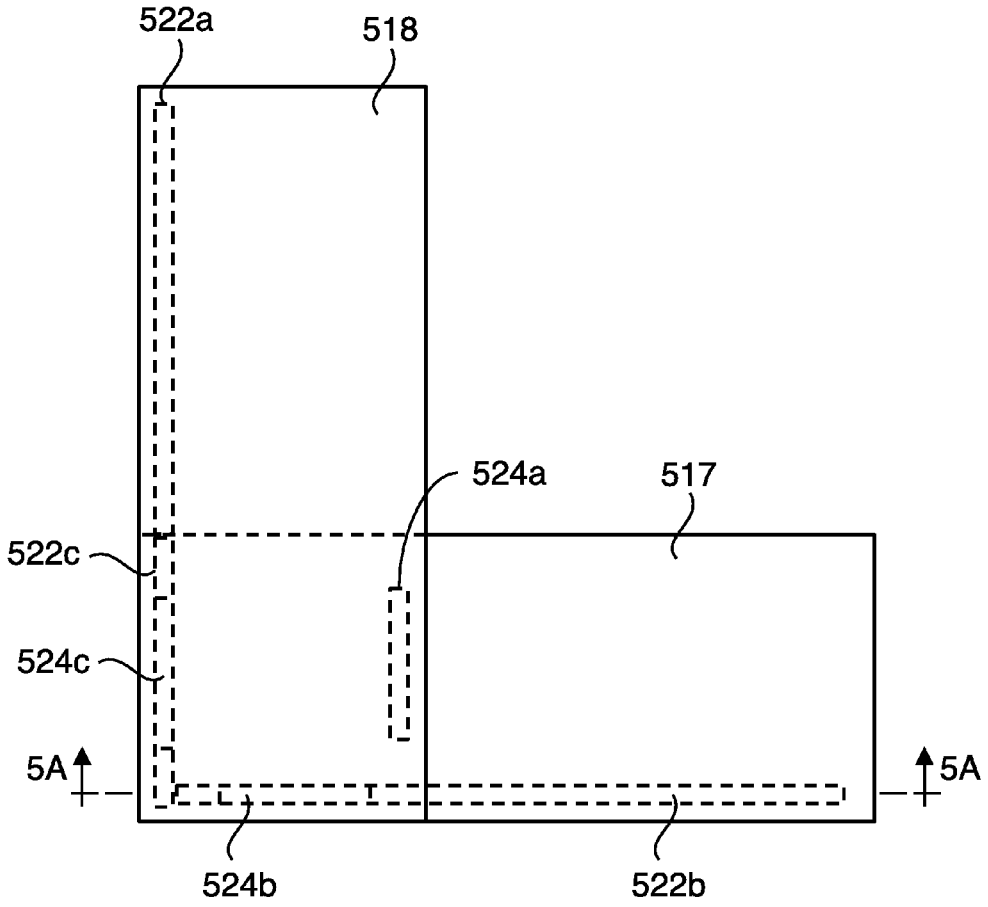
FIG. 5 is a top view of a portion of an absorbent floor system according to an embodiment of the present invention.
Figure 5A:
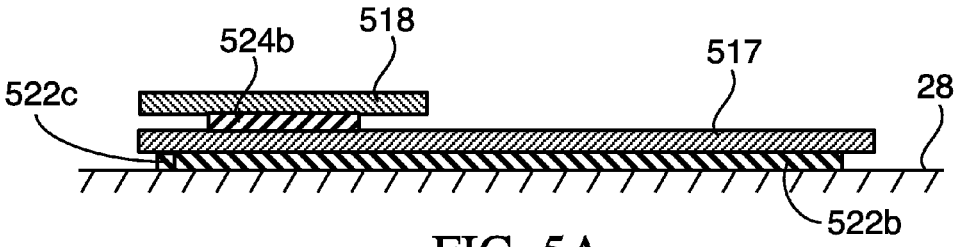
FIG. 5A is a section view of a portion of an absorbent floor system according to an embodiment of the present invention.
Figure 5B:
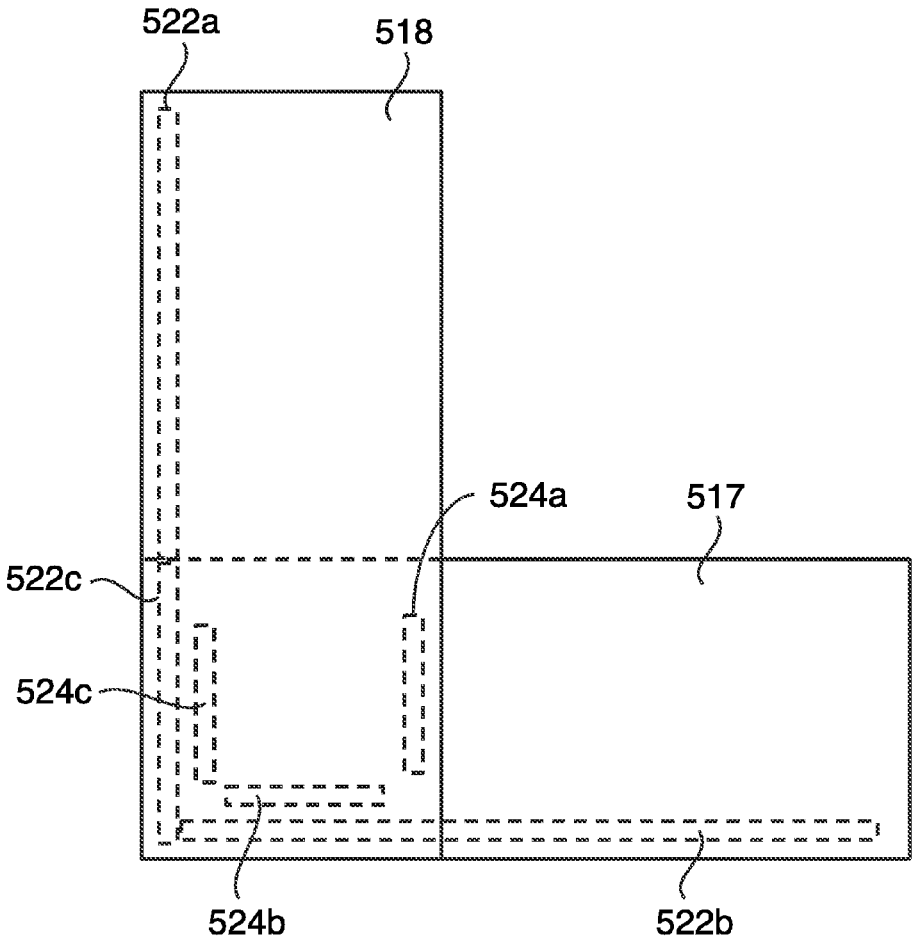
FIG. 5B is a top view of a portion of an absorbent floor system according to an embodiment of the present invention.

FIGS. 5, 5A and 5B illustrate other embodiments of arranging absorbent mats of an absorbent mat floor system. In this particular embodiment, most traveled walkway absorbent mat 518 is placed perpendicular to and partially overlaps pre-site custom cut walkway absorbent mat 517 such that the two absorbent mats are in an L-shape. Pre-site custom cut walkway absorbent mat 517 is secured to the floor using single sided hook fasteners 522*b* and 522*c*. Most traveled walkway absorbent mat 518 partially is secured to the floor using single sided hook fastener 522*a*, which in this particular embodiment abuts one end of single sided hook fastener 522*c*. Double sided hook fasteners 524*a*, 524*b* and 524*c* are used to secure and interlock most traveled walkway absorbent mat 518 and pre-site custom cut walkway absorbent mat 517. As shown in FIG. 5, double sided hook fasteners 524*b* and 524*c* can be located directly above single sided hook fasteners 522*b* and 522*c*. FIG. 5A shows a section view of how the most traveled walkway absorbent mat 518, pre-site custom cut walkway absorbent mat 517, double sided hook fastener 524*b*, and single sided hook fasteners 522*b* and 522*c* are sandwiched together when installed. In other embodiments as shown in FIG. 5B, double sided hook fasteners 524*b* and 524*c* can be located inside and within single sided hook fasteners

522*b* and 522*c* and can be located a distance within each other similar to distances (x), (y) and/or (z) as described more fully elsewhere herein.

Figure 6:
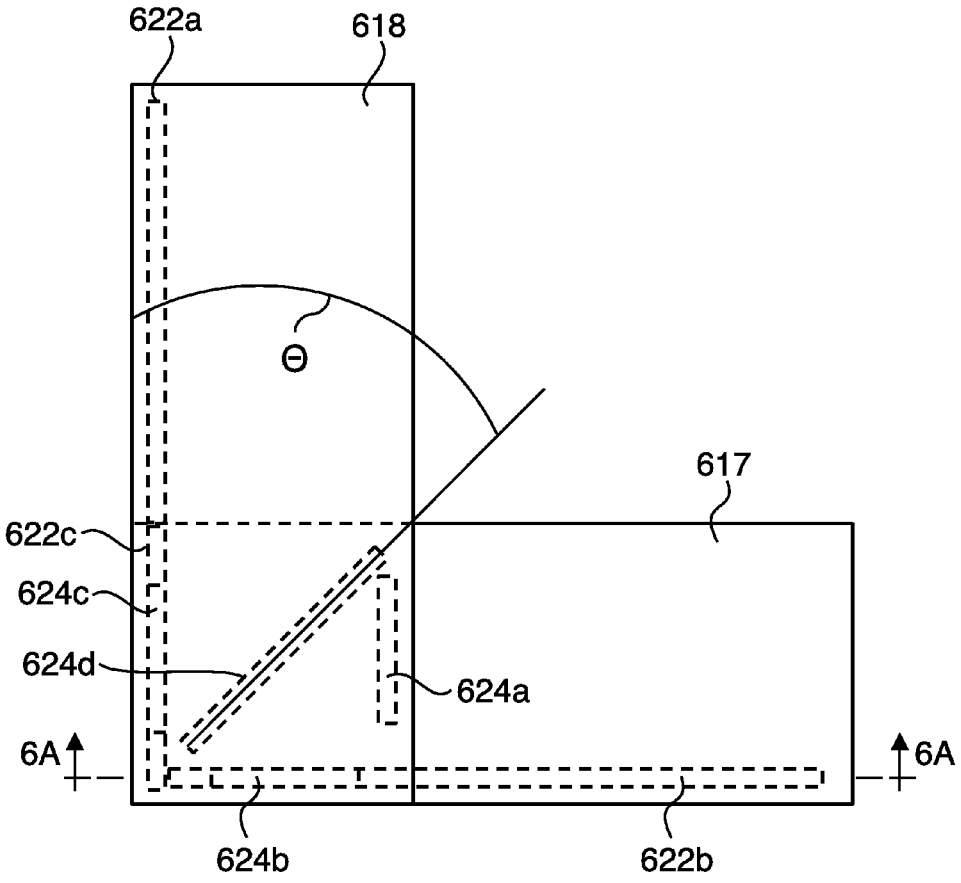
FIG. 6 is a top view of a portion of an absorbent floor system according to an embodiment of the present invention.
Figure 6A:
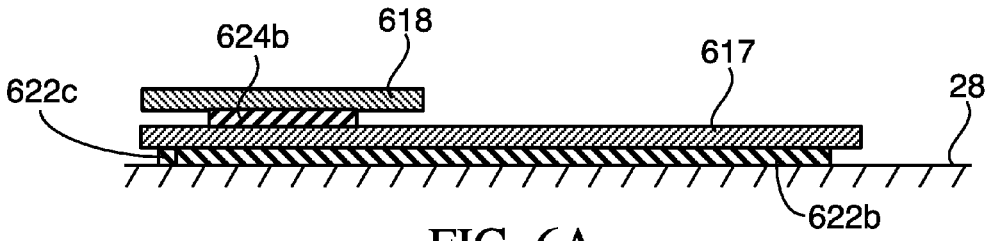
FIG. 6A is a section view of a portion of an absorbent floor system according to an embodiment of the present invention.

Additionally or alternatively, FIGS. 6 and 6A illustrate other embodiments of arranging absorbent mats of an absorbent mat floor system. In this particular embodiment, most traveled walkway absorbent mat 618 is placed perpendicular to and partially overlaps pre-site custom cut walkway absorbent mat 617 such that the two absorbent mats are in an L-shape. Pre-site custom cut walkway absorbent mat 617 is secured to the floor using single sided hook fasteners 622*b* and 622*c*. Most traveled walkway absorbent mat 618 is secured to the floor using single sided hook fastener 622*a*, which in this particular embodiment abuts one end of single sided hook fastener 622*c*. Double sided hook fasteners 624*a*, 624*b* and 624*c* are used to secure and interlock most traveled walkway absorbent mat 518 and pre-site custom cut walkway absorbent mat 517. An additional double sided hook fastener 624*d* is placed at an angle θ with respect to the longest side of most traveled walkway absorbent mat 518. In this particular embodiment, double sided hook fastener 624*d* is placed at about a 45 degree angle with respect to the longest side of most traveled walkway absorbent mat 518. In other embodiments, double sided hook fastener 624*d* may be placed between about a 10 degree angle to about an 80 degree angle with respect to the longest side of most traveled walkway absorbent mat 518 (e.g., about 10 degrees, about 20 degrees, about 30 degrees, about 40 degrees, about 50 degrees, about 60 degrees, about 70 degrees, about 80 degrees). As shown in FIG. 6, double sided hook fasteners 624*b* and 624*c* can be located directly above single sided hook fasteners 622*b* and 622*c*. FIG. 6A shows a section view of how the most traveled walkway absorbent mat 618, pre-site custom cut walkway absorbent mat 617, double sided hook fastener 624*b*, and single sided hook fasteners 622*b* and 622*c* are sandwiched together when installed.

Additionally or alternatively, FIGS. 7, 7A, 7B, and 7C illustrate other embodiments of arranging absorbent mats of an absorbent mat floor system 710. In this particular embodiment, absorbent mat floor system 710 is arranged in generally reversed C-shape pattern. Absorbent mat floor system 710 includes a population of single sided hook fasteners 722 adhered to a floor and a population of absorbent mats 716, 717, 718*a*, 718*b*, 718*c*, wherein one or more of the population of absorbent mats 718*a*, 718*b*, 718*c* are secured to the population of single sided hook fasteners 722. Additionally, absorbent mat floor system 710 includes a liner 750 which may be placed on top of the floor below the population of absorbent mats 716, 717, 718*a*, 718*b*, 718*c*. Preferably, liner 750 is placed directly on the floor; however, in certain embodiments, liner 750 may be placed between layers of absorbent mats.

Liner 750 may be used in installations where there is expected to be heavy saturation of oil, grease, coolant and/or other fluids and/or where there is the potential that such fluids could pollute or damage the floor (e.g., staining and/or degrading a concrete floor), drains, water sources etc. Liner 750 may be particularly desired for installation sites that do not have sealed concrete floors. Liner 750 is typically a plastic sheet or film that is laid on the floor. Multiple sheets of liner material may be laid down to form liner 750. In certain embodiments, the multiple sheets of liner material abut one another to form liner 750. In other embodiments, the multiple sheets of liner material may overlap one another to form liner 750. Accordingly, multiple sheets of liner material may be partially overlapped or abutted against one another to provide any width desired for the particular installation. Accordingly, for example, if a liner of 15 feet wide is desired, two sheets 8 feet wide maybe overlapped with 1 foot of overlap. Additionally, the multiple sheets of liner material may be adhered to one another in a variety of ways including, but not limited to, tape and/or adhesives. Liner 750 may also be adhered to the floor in a variety of ways including, but not limited to, tape and/or adhesives. Although only illustrated with respect to FIGS. 7, 7A, 7B, and 7C, it should be understood by one of ordinary skill that a liner may be used in any of the embodiments of absorbent floor system described herein.

A variety of widths and/or thicknesses of liner may be used. In one embodiment, for example, the liner may have a thickness of about 1-mil to about 20-mil (e.g., about 1-mil, about 2-mil, about 3-mil, about 6-mil, about 10-mil, about 12-mil, about 14-mil, about 15-mil, about 20-mil). In another embodiments, liner 750 has a thickness of about 3-mil to about 10-mil. In yet another embodiment, the liner has a thickness of about 6-mil.

In addition to the variety of thicknesses of liner contemplated by embodiments of the present, liners of varying widths may be utilized in the absorbent floor system. In one embodiment, liners vary in width from about 2 feet to about 20 feet. For example, one or more liners is about 2 feet wide, about 3 feet wide, about 4 feet wide, about 5 feet wide, about 6 feet wide, about 7 feet wide, about 8 feet wide, about 9 feet wide, about 10 feet wide, about 11 feet wide, about 12 feet wide, about 13 feet wide, about 14 feet wide, about 15 feet wide, about 16 feet wide, about 17 feet wide, about 18 feet wide, about 19 feet wide, about 20 feet wide. Liners may be provided from the manufacturer in 100 foot rolls and cut to any desired length and/or width. In certain embodiments, the liner is supplied as 10 feet by 100 feet by 6-mil black construction film produced and/or distributed under the Blue Hawk brand; however any commercially available plastic sheet or film may be used as a liner.

Figure 7:
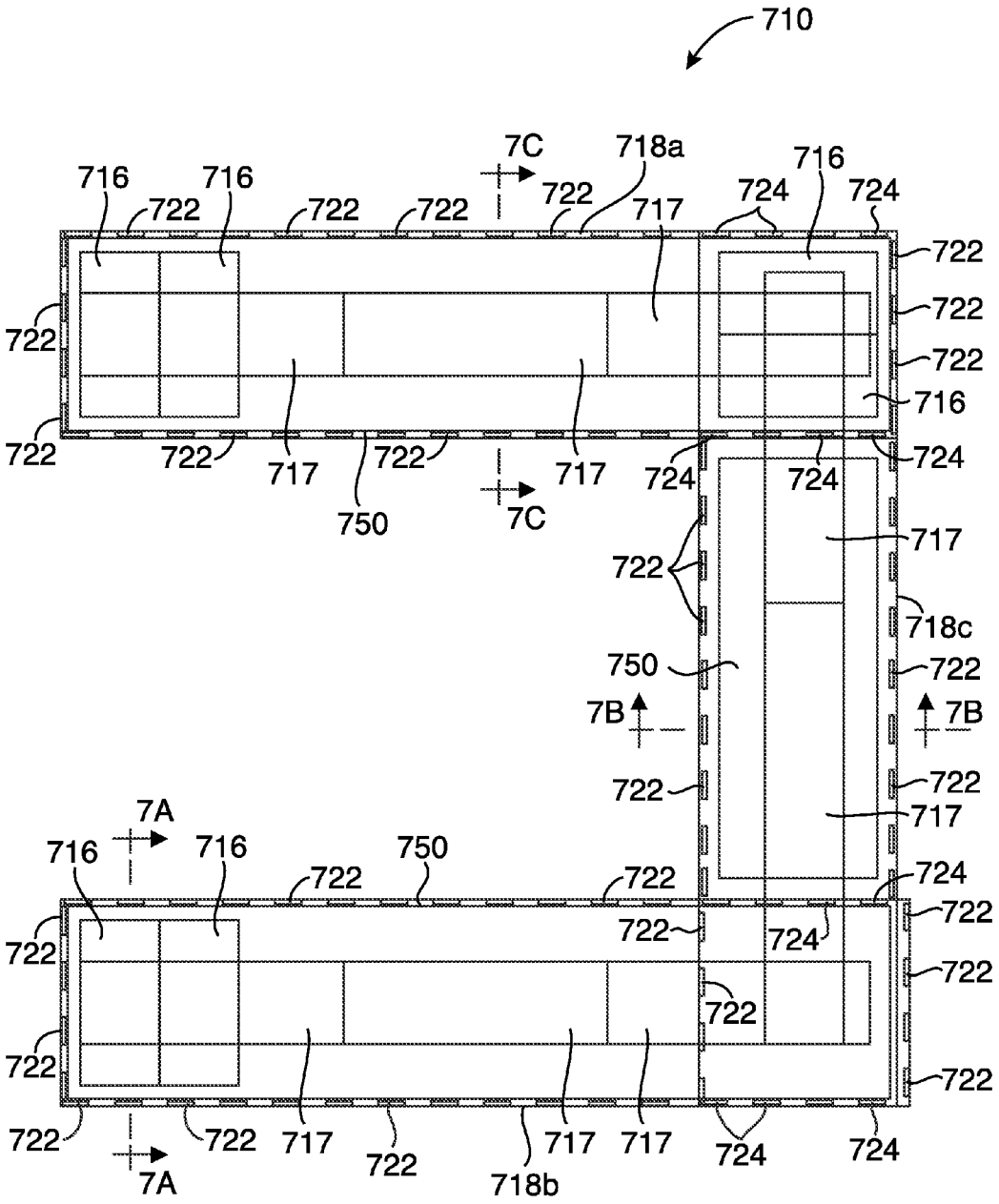
FIG. 7 is a top view of a portion of an absorbent floor system according to an embodiment of the present invention.
Figure 7A:
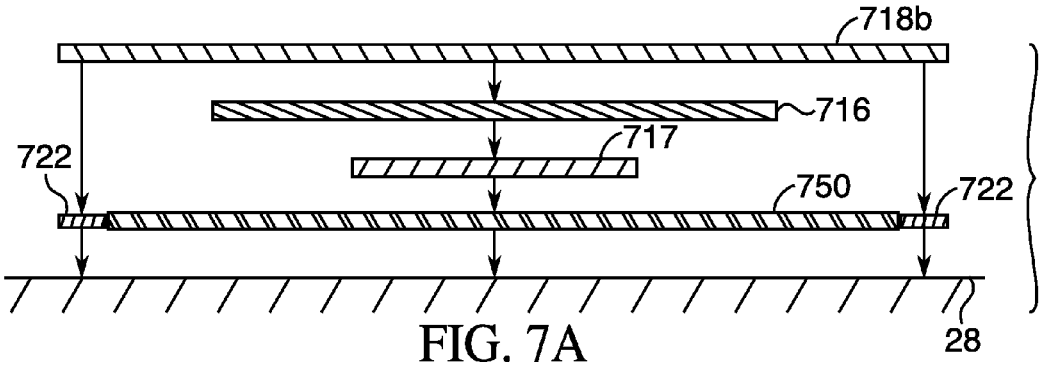
FIG. 7A is an exploded section view of a portion of an absorbent floor system according to an embodiment of the present invention.
Figure 7B:
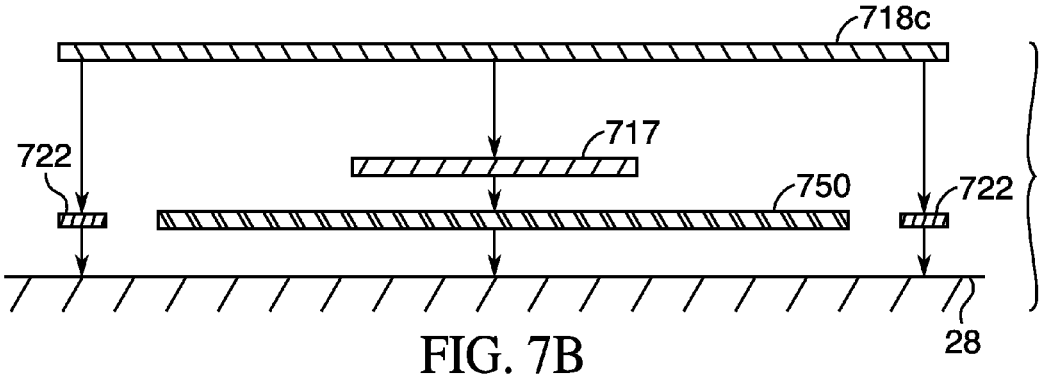
FIG. 7B is an exploded section view of a portion of an absorbent floor system according to an embodiment of the present invention.
Figure 7C:
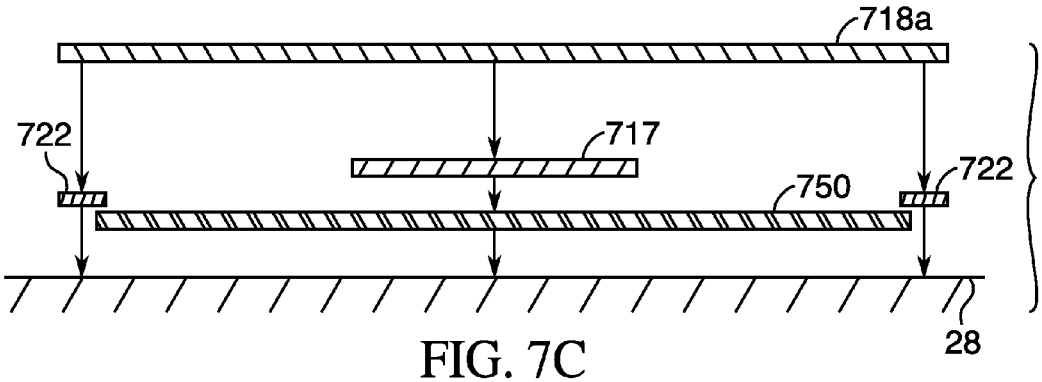
FIG. 7C is an exploded section view of a portion of an absorbent floor system according to an embodiment of the present invention.

Reference to various possible arrangements of liner 750 will now be described in detail with respect to FIGS. 7A, 7B and 7C. FIGS. 7A, 7B, and 7C illustrate exploded section views of absorbent floor system 750. It should be understood that absorbent mats 716, 717, 718*a*, 718*b*, 718*c* and liner 750 are not shown to scale. Additionally, it should be understood that any of the following arrangements, either alone or in combination may be used in a single installation of an absorbent floor system. Referring now to FIG. 7A, in certain arrangements, liner 750 is placed between single sided hook fasteners 722. The edges of liner 750 may be proximate to or abut the inner edges of single sided hook fasteners 722. In other arrangements, as shown in FIG. 7B, liner 750 may be narrower such that it does not abut the inner edges of single sided hook fasteners 722. Accordingly, as illustrated in FIGS. 7A and 7B, liner 750 may lie within the mat-hook-floor line formed by single sided hook fasteners 722. That is, the mat-hook-floor line may delineate a perimeter within which lies liner 750. In yet other arrangements, as shown in FIG. 7C, a portion of liner 750 may extend under the inner edges of single sided hook fasteners 722 such that a portion of liner 750 is below single sided hook fasteners 722 when absorbent floor system 710 is installed. Having a portion of liner 750 below single sided hook fasteners 722 may assist in keeping liner in place because liner 750 is adhered to the first side of single sided hook fastener 722 and the first side of single sided hook fastener 722 is adhered to the floor.

With reference again to FIG. 7, absorbent floor mat system 710 forms a substantially reversed C-shape walkway. Absorbent floor mat system includes liner 750 placed on the floor. A population of walkway absorbent mats 717 are placed or layered on top of liner 750. As shown, walkway absorbent mats 717 are substantially located in the central portions of the walkway. Walkway absorbent mats 717 may be pre-site custom cut absorbent mats or may be custom cut on-site. A population of absorbent mats 716 are placed or layered on top of a portion of the population of walkway absorbent mats 717. As shown, absorbent mats 716 are placed in three of four corners of absorbent floor mat system 710. Absorbent mats 716 may be placed in locations of high traffic or high usage, e.g., where there is the potential for a large amount of oil, grease, coolant, and/or other fluids to be present. Absorbent mats 716 may be pre-site custom cut absorbent mats or may be custom cut on-site. In various embodiments, fewer or greater number of absorbent mats 716, 717 may be used in the absorbent floor system.

A population of most traveled walkway mats 718*a*, 718*b*, 718*c* are placed or layered on liner 750, the population of walkway absorbent mats 717 and absorbent mats 716. A population of single sided hook fasteners 722 are adhered to the floor and the population of most traveled walkway mats 718*a*, 718*b*, 718*c* are secured to the population of single sided hook fasteners 722. Furthermore, a population of double sided hook fasteners 724 are used to secure most traveled walkway mat 718*a* to most traveled walkway mat 718*c* and to secure most traveled walkway mat 718*b* to most traveled walkway mat 718*c*. As shown, the population of walkway absorbent mats 717 and absorbent mats 716 are not secured to the population of most traveled walkway mats 718*a*, 718*b*, 718*c*. However, it should be understood from this disclosure that, in other embodiments, the population of walkway absorbent mats 717 and absorbent mats 716 may be secured to the population of most traveled walkway mats 718*a*, 718*b*, 718*c* using double sided hook fasteners 724. Furthermore, as shown in FIGS. 7, 7A, 7B, and 7C, the population of single sided hook fasteners 722 may be placed proximate the edges of most traveled walkway mats 718*a*, 718*b*, 718*c* such that the mat-hook-floor line and distance (y) (see FIG. 4) is less than about 3 inches. However, it should be understood from this disclosure that, in other embodiments, the population of single sided hook fasteners 722 may be placed a distance (y) equal to or greater than about 3 inches from the edges of most traveled walkway mats 718*a*, 718*b*, 718*c*.

The absorbent floor system can be deployed with various quantities of absorbent mats. The absorbent floor system preferably includes at least 5 absorbent mats, one or more of which are overlapping. In certain example embodiments, the absorbent floor system includes from 5 absorbent mats to about 20 absorbent mats, one or more of which are overlapping (e.g., about 5 absorbent mats, about 10 absorbent mats, about 15 absorbent mats, about 20 absorbent mats). In other example embodiments, the absorbent floor system includes 20 or more absorbent mats, most of which overlap at least one other absorbent mat of the system. In yet another example embodiment, the absorbent floor system includes 50 or more absorbent mats, most of which overlap at least one other absorbent mat of the system. In a further embodiment, the absorbent floor system includes 100 or more absorbent mats, most of which overlap at least one other absorbent mat of the system. In another embodiment, the absorbent floor system includes 150 or more absorbent mats, most of which overlap at least one other absorbent mat of the system.

The absorbent floor system is preferably deployed on a floor or section of a floor of at least about 100 square feet, although it may be deployed to cover an area of less than 100 square feet. In certain embodiments, the total area covered by the absorbent floor system is between about 100 square feet to more than 5000 square feet (e.g., about 100 square feet, about 250 square feet, about 500 square feet, about 750 square feet, about 1000 square feet, about 1250 square feet, about 1500 square feet, about 1750 square feet, about 2000 square feet, about 2500 square feet, about 3000 square feet, about 3500 square feet, about 4000 square feet, about 4500 square feet, about 5000 square feet, more than 5000 square feet). In another embodiment, the absorbent floor system covers about 10,000 square feet or more. In yet another embodiment, the absorbent floor system covers at least 20,000 square feet.

Site Evaluation and Planning

Figure 8:
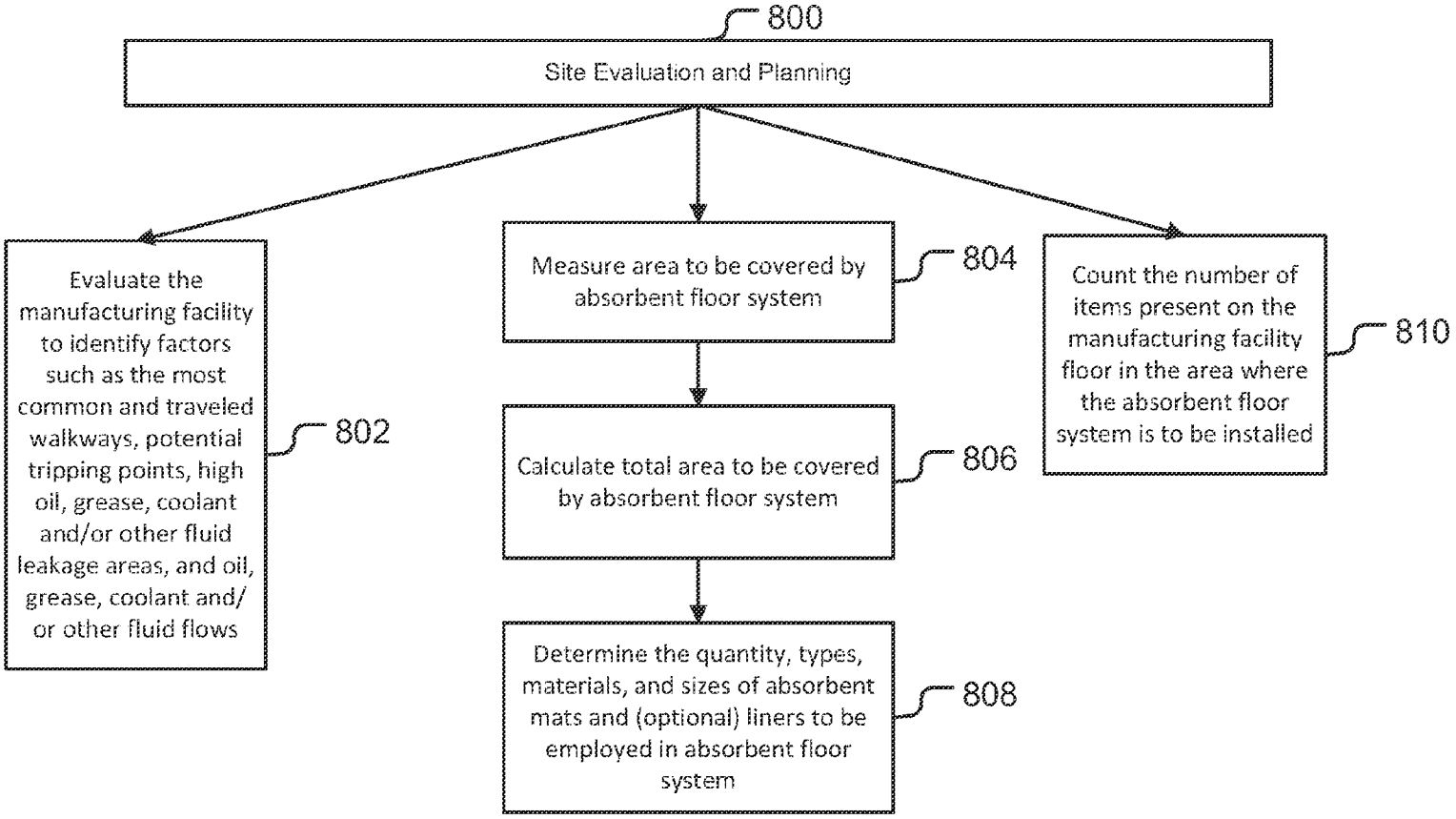
FIG. 8 is a chart describing certain steps of site evaluation and planning for an absorbent floor system according to an embodiment of the present invention.

In one embodiment, as illustrated in FIG. 8, site evaluation and planning is performed before installing an absorbent floor system 800 wherein the site planning and evaluation comprises evaluating the manufacturing facility to identify factors such as the most common and traveled walkways, potential tripping points, high oil, grease, coolant and/or other fluid leakage areas, and oil, grease, coolant and/or other fluid flows 802. Site evaluation and planning may also include determining whether any liners are required. Site evaluation and planning further comprises measuring the area to be covered by an absorbent floor system 804 and may further comprise photographing all or part of the area to be covered. The total area (e.g., square footage) of the area to be covered is calculated 806.

In certain preferred embodiments, site evaluation and planning includes identifying areas of high usage, e.g., where there is the potential for a large amount of oil, grease, coolant, and/or other fluids to be present. Identification of such areas may aid in selection of quantities, materials, and types of absorbent mats for use in such areas.

Site evaluation and planning may also include identification of areas in which the floor of the manufacturing facility slopes (e.g., near a drain, down a ramp, etc.). As described below, additional absorbent mats may be employed in such areas to minimize the slope of the walking surface and, accordingly, the need for such mats may be identified during site evaluation and planning. Based on the information gathered during site evaluation and planning, the quantity, types, materials, and sizes of absorbent mats and optional liners to be employed in an absorbent floor system for such site may be determined 808.

For example, based on the available sizes of standard absorbent mats, areas for which such standard absorbent mats are suitable may be identified and the required number and sizes of such standard absorbent mats may be calculated (e.g., for a particular site, based on site evaluation and planning, two standard absorbent mats having dimensions of 3 feet by 10 feet and two standard absorbent mats having dimensions of 2 feet by 3 feet may be selected for an absorbent floor system for such site).

By way of further example, sizes of and suitable materials for pre-site custom cut absorbent mats can be identified based on information gathered during site evaluation and planning, and one or more of such mats may be cut at a location other than the installation site. By cutting some mats prior to arriving at the installation site, installation time may be reduced and any downtime of the manufacturing facility where the absorbent floor system is to be installed may be reduced.

Site evaluation and planning 800 may include counting the number of objects present on the manufacturing facility floor in the area where the absorbent floor system is to be installed 810. Such objects may include work tables, machinery, railings, posts, and other structures. Based on the number and type of objects identified during site evaluation and planning, the quantity, sizes and materials for leaner absorbent mats of an absorbent floor system employed at such site may be determined. In some embodiments, site evaluation and planning may also include estimating the number of cuts required for leaner absorbent mats of the absorbent floor system.

As noted, based on information gathered during site evaluation and planning, materials suitable for the various absorbent mats of an absorbent floor system for such site can be identified. In one example embodiment, absorbent mats with relatively higher weights and/or relatively higher proportions of polypropylene are selected for high waste and high traffic areas and absorbent mats with relatively lower weights and/or relatively smaller proportions of polypropylene are selected for low waste or low traffic areas. In another embodiment, the same weight and composition is selected for all absorbent mats of the absorbent floor system.

In certain embodiments of the present invention, it is contemplated that the top most absorbent mats of the absorbent floor system are placed in the location of a most traveled walkway. Accordingly, site evaluation and planning may include identifying one or more most traveled walkways. In some embodiments, site evaluation and planning includes identifying potential tripping points and calculating the number and length of absorbent mats to reduce or avoid overlaps and/or seams at or near tripping points.

Thus after the site evaluation and planning has been completed, and the number of standard absorbent mats, leaner absorbent mats, pre-site custom cut absorbent mats, pre-site custom cut walkway absorbent mats, and/or most traveled walkway absorbent mats, number of layers, mat weight, etc. have been calculated or determined, the absorbent floor system can be installed. In other embodiments, such as reinstallation of an absorbent floor system, some or all of the components of site evaluation and planning described above are not performed prior to an installation.

Installation

Figure 9A:
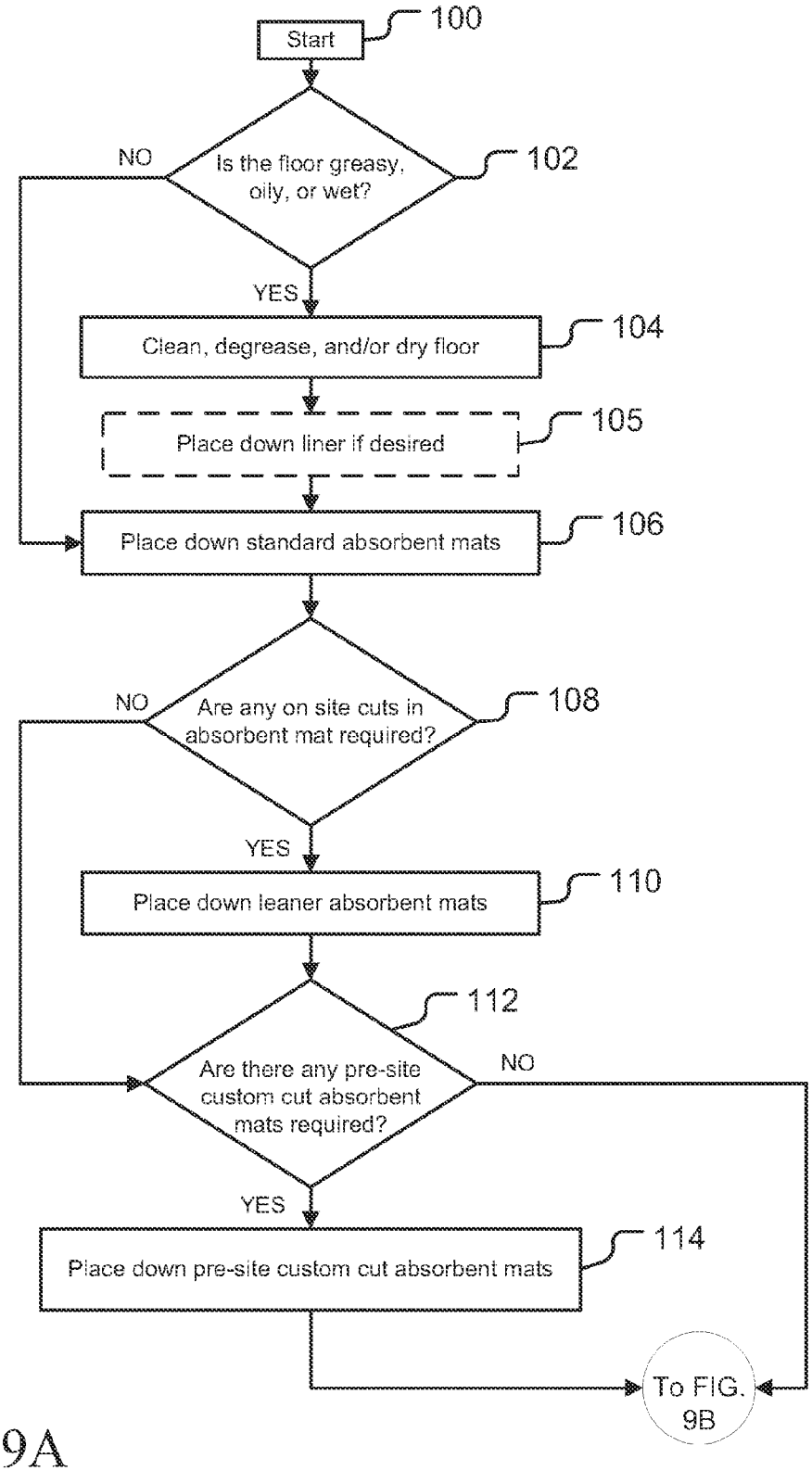
FIG. 9A is flow chart describing a portion of the method of installing an absorbent floor system according to an embodiment of the present invention.
Figure 9B:
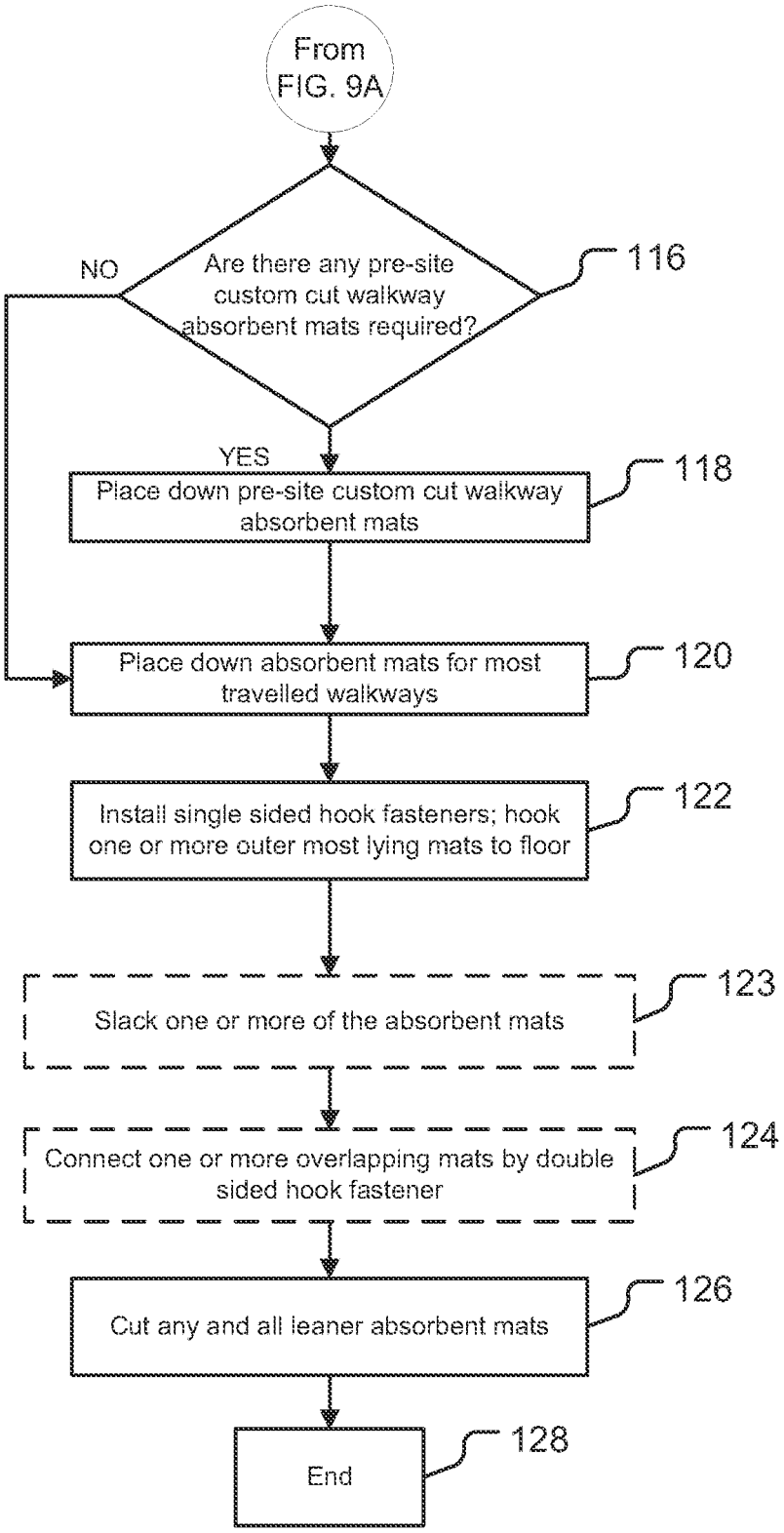
FIG. 9B is flow chart describing a portion of the method of installing an absorbent floor system according to an embodiment of the present invention.

FIGS. 9A and 9B illustrate one embodiment of a method of installing an absorbent floor system 100. At step 102, the floor condition is determined, e.g., whether it is greasy, oily, wet and/or dirty in any other way. The floors of manufacturing facilities may be saturated with oil, grease, fluids, and/or other chemicals, the presence of which may inhibit the adhesion of the single sided hook fasteners to the floors. Accordingly, if the floor is dirty, the floor is cleaned, degreased and dried at step 104. The floor may be cleaned with a mop and any commercially available degreaser. The floor may also be further manually or mechanically cleaned where the single sided hook fasteners will be adhered to the floor using a variety of cleaning means including, but not limited to, rags, brushes, buffing pads, orbital floor cleaners, vacuums, etc.

In one example embodiment, the floor is degreased by mopping an EF-80 Degreaser produced by Waste Controllers of St. Louis, Mo. on the floor. According to this example embodiment, after the floor is degreased, the floor is manually dried in the location where the single sided hook fasteners will be adhered to the floor (i.e., the mat-hook-floor line). That is, the line along which the single sided hook fasteners will be adhered to the floor is manually dried. In this embodiment, the step of manually drying is completed using low lint micro-fiber wipes. Using the low lint micro-fiber wipes aids in minimizing the number of particles remaining on the floor where the single sided hook fasteners will be adhered (which could adversely impact the integrity of the adhesive on the single sided hook fastener). Accordingly, thoroughly cleaning the floor increases the adhesion between the floor and the single sided hook fastener, reducing or eliminating the need for additional means of retaining the absorbent mats such as tapes, glues, etc. Additionally, cleaning, degreasing and drying the floor aids in extending the life of the adhesion of the single sided hook fasteners to the floor. This also aids in increasing durability of the absorbent floor system because the single sided hook fasteners may be less likely to detach from the floor and, therefore, the absorbent mats may be less likely to slip or be otherwise displaced.

After the floor is cleaned, degreased and dried, a liner is placed on the floor if desired at step 105. This step is optional, as not all installations will utilize a liner. Then mats selected for the absorbent floor system are placed down on the floor at steps 106 through 120. For example, at step 106, standard absorbent mats are placed down on the floor. If any on site cuts in absorbent mats are required at step 108, then leaner absorbent mats are placed down on the floor at step 110. If any pre-site custom cut absorbent mats are required at step 112, then pre-site custom cut absorbent mats are placed down on the floor at step 114. Continuing now to FIG. 9B, if any pre-site custom cut walkway absorbent mats are required at step 116, then pre-site custom cut walkway absorbent mats are placed down on the floor at step 118. Then, at step 120, the absorbent mats for the most traveled walkways are placed down on the floor. In some embodiments, multiple layers of mats are laid in certain areas, e.g., high usage areas, high waste areas, or sloped areas.

Although, in general, absorbent mats of an absorbent floor system may be initially placed on the floor in any order, in preferred embodiments of absorbent floor systems, a most traveled walkway absorbent mat lies at least partially on top of the absorbent mats adjacent to the most traveled walkway mat. Placing the most traveled walkway absorbent mats on top of one or more previously placed absorbent mats in the absorbent floor system aids in reducing tripping hazards and permits easier removal and replacement of the most traveled walkway mats if needed.

More generally, mats are preferably installed (and, therefore, ultimately placed) such that an inner-most mat lies directly on the floor and, moving away from such inner-most mat, additional mats lay, in part, on top of an adjacent mat and, in part, on the floor.

For example, as illustrated in FIG. 1A, standard absorbent mat 12 lies fully on the floor and leaner absorbent mats 14*a* and 14*e* lie partially on top of standard absorbent mat 12 and partially on the floor. In this embodiment: leaner absorbent mats 14*c* and 14*d* lie partially on top of standard absorbent mat 12; leaner absorbent mat 14*b* lies partially on top of leaner absorbent mats 14*c* and 14*d*; pre-site custom cut absorbent mat 16*a* lies partially on top of leaner absorbent mats 14*b*, 14*c*, and 14*d*; pre-site custom cut walkway absorbent mat 17*a* lies partially on top of pre-site custom cut absorbent mat 16*a*. Finally, most traveled walkway mat 18*a* lies on top of absorbent mats 17*a*, 16*a*, 14*b*, 14*c*, 14*a*, 12, 14*e*, 14*g*, 14*f*, 16*b*, and 17*b*.

Other placement variations can be used in other embodiments that maintain, at least generally, the preferred inner to outer layering. For example, in another embodiment, absorbent mat 16*a* could be placed directly on the floor and mats 14*b*, 14*c*, and 14*d* could be placed partially on top of absorbent mat 16*a*. In yet another embodiment, absorbent mats 14*a* and 14*b* could be placed directly on the floor, and absorbent mats 14*c*, 14*d*, and 12 could be placed partially on top of absorbent mat 14*a*.

During installation lower level mats are preferably placed at sufficient distance within the mat-hook-floor line, as described more fully elsewhere herein. By keeping the edges of the lower level mats within the mat-hook-floor line, the outer most lying mats can lie substantially flat allowing for better securing to the single sided hook fasteners and a smoother edge may be created thus reducing or eliminating potential tripping points. In a preferred embodiment, no portion of the lower level mats extends beyond the mat-hook-floor line.

Referring again to FIG. 9B, after the mats have been placed on the floor, at step 122 one or more single sided hook fasteners (for example, single sided hook fasteners 22*a*-22*d* in FIG. 1) are adhered to the floor forming the mat-hook-floor lines of the absorbent floor system and one or more or all of the outer most mats are secured to one or more of the single sided hook fasteners as described more fully elsewhere herein. In certain embodiments, the outer most mats may be pre-site custom cut walkway mats (for example, pre-site custom cut walkway mats 17*a* and 17*b* in FIG. 1) and most traveled walkway mats (for example, most traveled walkway mats 18*a* and 18*b*). In other embodiments, the outer most mats may be standard absorbent mats, leaner absorbent mats, and/or pre-site custom cut absorbent mats.

In some embodiments, in order to enhance the absorbent floor system, to further reduce or eliminate potential tripping points, and to ensure that the single sided hook fasteners are cut to the proper length, the slack may be removed from the absorbent mats at step 123 through an optional process called slacking. During slacking, a first short side of an absorbent mat is secured to one or more single sided hook fasteners. Then, the second short side of the absorbent mat is pulled until the absorbent mat is taught, e.g., reducing the likelihood of ridges in the absorbent mat post-installation. The second short side of the absorbent mat is then secured to one or more single sided hook fasteners. After the two short sides of the absorbent mat have been secured along their short sides, one or more single sided hook fasteners may be cut to the desired length and then attached to the floor under the portion of the absorbent mat that lies directly on the floor. The absorbent mat can be secured to the single sided hook fasteners, as described more fully elsewhere herein.

Slacking can be particularly useful in installing absorbent mats over 6 feet in length, however slacking can be performed on any length of absorbent mat. Additionally, on-site custom cuts can aid in holding the mat in place. By performing slacking of leaner absorbent mats prior to cutting, the cuts are more likely to be in the correct location, thereby minimizing the necessity of additional cuts or unintended tripping hazards from misplaced cuts. After the outer most mats are secured to the floor using single sided hook fasteners, at optional step 124 one or more or all of the overlapping mats are secured to or interlocked with one another using one or more double sided hook fasteners (for example, double sided hook fasteners 24*a*-24*aa* in FIG. 1). In certain embodiments, all of the overlapping mats are secured to or interlocked with one another using one or more double sided hook fasteners, while in other embodiments, none of the overlapping mats are secured to or interlocked with one another using one or more double sided hook fasteners. By securing or interlocking one or more or all of the overlapping mats to one another, potential tripping hazards may be reduced because the mats are not permitted to rise up or shift.

In certain embodiments, the layered absorbent mats may be secured to or interlocked with each other using double sided hook fasteners, while in other embodiments the layered absorbent mats may not be secured to or interlocked with each other using double sided hook fasteners. By not interlocking the layered mats in certain embodiments, these mats can be easily swapped out with clean mats prior to a full reinstallation of the entire absorbent floor system. These layered absorbent mats may also be covered or overlapped by any absorbent mat as described elsewhere herein such as pre-site custom cut absorbent mats, pre-site custom cut walkway absorbent mats, most traveled walkway absorbent mats, etc.

Finally, at step 126 once one or more or all mats have been secured to one another using double sided hook fasteners, any and all leaner absorbent mats are custom cut on-site (for example, cuts 230*a* and 230*c* in FIGS. 2 and 3) to accommodate and aid in the fit of the absorbent floor system around and/or under legs, protrusions, etc. of the objects present on the manufacturing facility floor (for example, objects 11*a* and 11*b* in FIG. 1). While steps are described herein in one order, it will be understood that other embodiments of the method can be carried out in any order without departing from the scope of the invention.

More specifically, in certain embodiments, during installation, absorbent mats are leaned against the objects present on the manufacturing facility floor and are therefore called "leaners." To accommodate and aid in the fit of the absorbent floor system around legs, protrusions, etc. of the objects present on the manufacturing facility floor, the leaner absorbent mats in these particular areas are custom cut on-site during installation. Once the custom cuts are made into the leaner absorbent mats, the leaner absorbent mats can then lie substantially flat on the manufacturing facility floor and/or under the objects present on the manufacturing floor. The custom cuts can be a simple line cut or a complex curve. Additionally, a variety of shapes can be cut into the leaner absorbent mats including, but not limited to, triangles, squares, circles, half-circles, ovals, etc. Accordingly any shape can be cut into leaner absorbent mat to accommodate and aid in the fit of the absorbent floor system around legs, protrusions, etc. of the objects present on the manufacturing facility floor (for example, objects 11*a* and 11*b* in FIG. 1). Once the on-site custom cuts are made into the leaner absorbent mats, the leaner absorbent mats can then lie substantially flat on the floor.

In certain embodiments, for example, the custom cut may be from about 2 inches in length to about 12 inches in length (e.g., about 2 inches in length, about 4 inches in length, about 6 inches in length, about 8 inches in length, about 10 inches in length, and/or about 12 inches in length). Custom cutting the leaner absorbent mats on-site not only aids in allowing the leaner absorbent mats to lie substantially flat on the floor but, in combination with slacking, aids in maintaining the desired position of the absorbent floor system. The custom on-site cuts can be made with a wide variety of tools including, but not limited to, shears, razor knives, carpet knives, hot knives, etc. Preferably, the custom on-site cuts may be made with a hot knife typically used to cut foam because it can produce a clean cut with no frayed edges. Custom on-site cuts can also be made using the same tools on any absorbent mat of the absorbent floor system that will aid in the fit and finish of the entire system. Typically a straight edge may be used to make any straight cuts.

If needed or desired, one or more layers of absorbent mat may be placed in the high usage areas. By utilizing multiple layers of absorbent mat, oil, grease, coolant, and/or other fluids can accumulate in the lower absorbent mats while the top mats remain substantially dry or free of oil and/or grease. Additionally, the multiple layers of absorbent mats in high usage areas can permit even absorption throughout the entire absorbent floor system such that the high usage areas and lower usage areas become saturated at substantially the same time. This can reduce cost to the customer because the entire absorbent floor system can be changed out at the same time instead of mat by mat. Alternatively, one or more of the absorbent mats may be removed and replaced without removing or replacing the entire absorbent floor system. The multiple layers of absorbent mats may also provide cushioning for persons walking on the absorbent floor system such that a separate cushion layer is not required.

In certain manufacturing facilities, the floor may be sloped. The slope of the floor can be measured and the number of layers of absorbent mat required to create a substantially level surface in the absorbent floor system can be calculated. By layering the absorbent mats to create a substantially level surface, the propagation of the oil, grease, coolant and/or other fluid across the floor may be slowed and may aid in even absorption of oil, grease, coolant, and/or other fluids throughout the entire absorbent floor mat system. The number of layers of absorbent mat required to achieve a substantially level surface may depend on the slope of the floor and the weight of the absorbent mat being used. Accordingly, fewer layers of absorbent mats may be required for lesser slopes and more layers of absorbent mats may be required for greater slopes. Accordingly, fewer layers of heavier weight absorbent mats may be used or more layers of lighter weight absorbent mats may be used. In one embodiment, for example, a portion of the floor of the manufacturing facility may slope downward 0.5 inches over a 5 foot length from north to south. In this embodiment, two layers of 15 ounce absorbent mat may be placed on the higher, north end of the slope and three layers of 15 ounce absorbent mat may be placed on the lower, south end of the slope. In another embodiment, for example, a portion of the floor of the manufacturing facility may slope downward 0.75 inches over a 5 foot length from north to south. In this embodiment, three layers of 15 ounce absorbent mat may be placed on the higher, north end of the slope and four layers of 15 ounce absorbent mat may be placed on the lower, south end of the slope. In another embodiment, for example, a portion of the floor of the manufacturing facility may slope downward 0.5 inches over a 5 foot length from north to south. In this embodiment, one layer of 24 ounce absorbent mat may be placed on the higher, north end of the slope and two layers of 24 ounce absorbent mat may be placed on the lower, south end of the slope. In yet another embodiment, for example, a portion of the floor of the manufacturing facility may slope downward 0.75 inches over a 5 foot length from north to south. In this embodiment, two layers of 24 ounce absorbent mat may be placed on the higher, north end of the slope and three layers of 24 ounce absorbent mat may be placed on the lower, south end of the slope.

Multiple layers of absorbent mats may be used to reduce or eliminate the flow of oil, grease, coolant and/or other fluids. In an example embodiment, absorbent mats are layered near the edges and/or walkways of the absorbent floor system. Accordingly, in this embodiment, fluids (e.g., resulting from a spill of oil, grease, or coolant) would have to travel through the multiple layers before reaching the edges and/or walkways of the absorbent floor system. Thus, by providing multiple layers of absorbent mats near the edges and/or walkways of the absorbent floor system, fluids may be slowed and/or stopped before reaching an area such as a walkway or a portion of the manufacturing facility floor that is not covered by the absorbent floor system. The multiple layers may therefore serve as a "wall" or "hill" impeding the flow of oil, grease, coolant and/or other fluids.

In an example embodiment, an absorbent floor system is deployed on a manufacturing facility floor that includes an oven. In this example embodiment, three layers of absorbent mats are installed near the oven. Accordingly, a spill of oil, grease, coolant and/or other fluids on the absorbent floor system would be impeded as it flowed toward the oven by the first mat layer, the second mat layer and the third mat layer.

In embodiments of the absorbent floor system in which a layer of absorbent mats is deployed, the absorbent mats may be layered in a step-wise fashion, such that there is a distance from the edge of the first mat layer and the edge of the second mat layer and another edge from the third mat layer, and so on. Alternatively, the layers of absorbent mats may be coextensive such that the edges of all of the absorbent mats are substantially collinear. In certain embodiments, a single absorbent floor system may employ both types of layering.

If any individual absorbent mats in the absorbent floor system become oversaturated with oil, grease, coolant and/or other fluids over time more so than other absorbent mats in the absorbent floor system, those individual mats may be removed and replaced without replacing the entire absorbent floor system. However, in certain embodiments, the absorbent floor system may be designed so that the entire absorbent floor system can be dismantled such that all the absorbent mats are replaced at the same time. In certain embodiments, the absorbent floor system is dismantled by first removing all of the double sided hook fasteners from the overlapping mats. Then the most traveled walkway absorbent mats and pre-site custom cut walkway absorbent mats may be removed, followed by all pre-site custom cut absorbent mats, leaner absorbent mats and then the all standard absorbent mats. This embodiment of the dismantling process whereby layers are removed is essentially the reverse of the installation process. In other embodiments, dismantling the absorbent floor system may start on a first side of the system and work toward a second side of the system wherein all layers are removed as dismantling progresses from the first side to the second side. If a reinstallation of a new absorbent floor system is contemplated, the single sided hook fasteners may be left adhered to the floor so that they can be reused. In other embodiments, the single sided hook fasteners can be replaced for a variety of reasons including, but not limited to, if they are damaged, are no longer adhered to the floor, the absorbent mats will no longer attach to the hook fasteners, etc. The used absorbent mats may then be placed in a variety of containers including, but not limited to, totes, bins, 55 gallon drums, carts, etc. Preferably, at least one 55 gallon drum is supplied with the absorbent floor system into which the used absorbent mats may be placed.

After the absorbent mats of an absorbent floor system have been removed, they can be cleaned and reused in a variety of ways. In one embodiment, for example, an absorbent mat that is 3 feet by 20 feet can be cut down to a standard absorbent mat size including, but not limited to, about 18 inches by about 18 inches, about 18 inches by about 3 feet, about 18 inches by about 6 feet, about 2 feet by about 3 feet, about 3 feet by about 6 feet, etc. feet so that it can be used in another absorbent floor mat system installation. In another embodiment for example, the custom cuts of a leaner absorbent mat can be cut off such and the resulting absorbent mat can be used in another absorbent floor system. The portions of the leaner mats that had the custom cuts, which were then cut off after dismantling the absorbent floor system can, in certain embodiments, be shredded and inserted into absorbent socks. Therefore, none or very little absorbent mat material is wasted. This reduces the amount of absorbent mat material going to landfills and thus provides an additional advantage over the prior art.

Various features of the described invention have been shown and described in connection with the illustrated embodiments. However, it is to be understood that these features are presented herein as being illustrative of the subject invention, and that the scope of the invention is to be determined by the appended claims.

What is claimed is:

1. A method of installing an absorbent floor system comprising a plurality of absorbent mats on a floor of a manufacturing facility, comprising the steps of:

adhering one or more single sided hook fasteners to the floor, wherein each of the single sided hook fasteners comprises a first smooth surface adhered to the floor and a second opposing surface having a plurality of hooks, and wherein the one or more single sided hook fasteners define a mat-hook-floor line of the absorbent floor system;

securing at least one of the plurality of absorbent mats directly to the one or more single sided hook fasteners by connecting the plurality of hooks of the single sided hook fasteners to the at least one absorbent mat;

overlapping a portion of one of the absorbent mats over a portion of an underlying absorbent mat of the plurality of absorbent mats;

securing the overlapping absorbent mat to the underlying mat using a double sided hook fastener, wherein the double sided hook fastener comprises a first surface having a first plurality of hooks and a second opposing surface having a second plurality of hooks, and wherein the first plurality of hooks and the second plurality of hooks are each connected to the overlapping absorbent mat and the underlying absorbent mat; and placing a liner comprising a plastic sheet or film on the floor of the manufacturing facility prior to placing the plurality of absorbent mats on the floor, wherein one of the single sided hook fasteners comprises a first portion of the first smooth surface and a second portion of the first smooth surface, and wherein the first portion is adhered to the liner and the second portion is adhered to the floor.

* * * * *